US012251618B2

(12) United States Patent
Norquist et al.

(10) Patent No.: US 12,251,618 B2
(45) Date of Patent: Mar. 18, 2025

(54) TOPOGRAPHICAL PLAYGROUND STRUCTURES, A STRUCTURAL FRAMEWORK THEREOF, AND A METHOD OF MAKING THE TOPOGRAPHICAL STRUCTURES

(71) Applicant: PlayCore Wisconsin, Inc., Chattanooga, TN (US)

(72) Inventors: Thomas Robert Norquist, Fort Payne, AL (US); Tin-Man Lau, Auburn, AL (US); Elisabeth Mathis, Birmingham, AL (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 287 days.

(21) Appl. No.: 17/889,649

(22) Filed: Aug. 17, 2022

(65) Prior Publication Data

US 2023/0054943 A1 Feb. 23, 2023

Related U.S. Application Data

(60) Provisional application No. 63/234,985, filed on Aug. 19, 2021.

(51) Int. Cl.
*A63B 9/00* (2006.01)

(52) U.S. Cl.
CPC ..... *A63B 9/00* (2013.01); *A63B 2009/006* (2013.01); *A63B 2208/12* (2013.01)

(58) Field of Classification Search
CPC ..... A63B 9/00; A63B 2009/004; A63B 2009/006; A63B 2208/12; A63B 2009/00; E01C 13/02
See application file for complete search history.

(56) References Cited

U.S. PATENT DOCUMENTS 3,737,161 A * 6/1973 Taylor ..... A63B 9/00 472/137
5,370,480 A * 12/1994 Quaney ..... E02D 29/0241 405/262

(Continued)

FOREIGN PATENT DOCUMENTS

RU 2015724 C1 7/1994
WO WO-9617133 A1 * 6/1996 ..... E02D 17/202

OTHER PUBLICATIONS

International Search Report and Written Opinion for Application No. PCT/US2022/40563, mailed Nov. 18, 2022, 7 pages.

*Primary Examiner* — Garrett K Atkinson
(74) *Attorney, Agent, or Firm* — McAndrews, Held & Malloy, Ltd.

(57) ABSTRACT

The present disclosure is directed to artificial topographical structures, such as mounds, installed at playgrounds using a structural framework. The structural framework is made up of a first plurality of panels extending in a first direction and a second plurality of panels extending in a second direction, with the second direction being transverse to the first direction. Each of the second plurality of panels may be connected to one or more of the first plurality of panels, such as through a complementary arrangement of slots. The artificial structure also includes at least a support layer and a cushion layer. The upper edges of the panels are designed to together provide an artificial mound having a defined contour.

23 Claims, 22 Drawing Sheets

(56) References Cited

U.S. PATENT DOCUMENTS

| | | | | |
|---|---|---|---|---|
| 6,228,005 | B1 * | 5/2001 | Gray | A63B 21/068 482/148 |
| 6,467,575 | B1 * | 10/2002 | Chen | A62B 1/20 182/48 |
| 7,229,334 | B2 * | 6/2007 | Ishikawa | A63H 33/042 446/116 |
| 9,206,581 | B2 * | 12/2015 | Mollick | A63B 17/04 |
| 9,493,923 | B1 * | 11/2016 | Miller | E02D 29/0225 |
| 10,597,893 | B2 * | 3/2020 | Tersigni | E04H 12/2292 |
| 2009/0162147 | A1 * | 6/2009 | Klenert | E04C 1/395 52/578 |
| 2012/0020745 | A1 * | 1/2012 | Miller | E02D 29/0241 405/284 |
| 2012/0174510 | A1 * | 7/2012 | Mollick | E02D 27/32 52/745.21 |
| 2017/0138013 | A1 * | 5/2017 | Woolbright | E02D 29/0225 |
| 2018/0295791 | A1 * | 10/2018 | Calle | A01G 25/02 |
| 2019/0150373 | A1 * | 5/2019 | Calle | E02D 29/0283 |
| 2019/0263090 | A1 * | 8/2019 | Allen | A47C 1/143 |
| 2023/0054943 | A1 * | 2/2023 | Norquist | A63B 9/00 |

* cited by examiner

TOPOGRAPHICAL PLAYGROUND STRUCTURES, A STRUCTURAL FRAMEWORK THEREOF, AND A METHOD OF MAKING THE TOPOGRAPHICAL STRUCTURES

The present application claims priority to U.S. Provisional Patent Application No. 63/234,985, filed on Aug. 19, 2021, the entirety of which is incorporated by reference herein.

BACKGROUND

Topographic features, such as artificial mounds, provide a playground with unique play opportunities. Historically, however, the installation of artificial mounds has been subject to a variety of drawbacks, including the need for specialized labor, high costs, lack of consistency, and a general inability to create complex topographies.

SUMMARY OF THE INVENTION

Embodiments of the present disclosure are directed to topographical structures for playgrounds, such as mounds; sets of components that form a framework for those topographical structures; methods of making those topographical structures using sets of components to form a framework; and playgrounds comprising those topographical structures, including embodiments in which one or more elements of a playground unit are incorporated into one or more of the topographical structures. Embodiments of the present disclosure allow for the production of a customizable and easily installed playground topography.

Embodiments of the present disclosure are directed to artificial topographical structures for playgrounds, such as artificial mounds. The artificial topographical structure, e.g. mound, includes a structural framework made up of a first plurality of structural elements having longitudinal axes extending in a first direction, and a second plurality of structural elements having longitudinal axes extending in a second direction, wherein the second direction is transverse to the first direction. Each of the second plurality of structural elements is connected to one or more of the first plurality of structural elements to form the structural framework. Each structural element has an upper edge, with the upper edges of the structural elements together being configured to provide the artificial structure, e.g. mound, with a contoured surface that may be determined prior to installation, i.e. predetermined.

Once assembled, the structural framework defines a plurality of spaces, i.e. cells, between adjacent structural elements. A fill material, for example crushed stone (examples of which are sometimes referred to as crush and run, crushnrun, or crusher run), is filled into and present in those spaces. One or more layers cover the structural framework and/or the fill material. In some embodiments, the one or more layers comprise or consist of a support layer, for example concrete, and a cushion layer, for example poured-in-place rubber. In some embodiments, the one or more layers may also comprise a finish layer, for example a poured-in-place rubber cap layer, synthetic grass, or turf. At least the top layer of the artificial topographical structure, e.g. mound, may be the same as the surrounding play surface, such that the transition from the play surface into the topographical structure is smooth and seamless.

In some embodiments, the structural framework may be made up of a first plurality of structural elements having longitudinal axes extending in a first direction, and a second plurality of structural elements having longitudinal axes extending in a second direction, wherein the second direction is perpendicular or substantially perpendicular to the first direction, such that the longitudinal axes of the second plurality of structural elements form right angles with the longitudinal axes of the first plurality of structural elements, e.g. to create a grid.

In some embodiments, the first plurality of structural elements and the second plurality of structural elements may be connected together through one or more, and typically a plurality, of slots, each of which receives a portion of the connected structural element. For instance, at least one of the second plurality of structural elements, and desirably each of the second plurality of structural elements, may have one or more slots, each of which having received a portion of one of the first plurality of structural elements. Alternatively or additionally, at least one of the first plurality of structural elements, and desirably each of the first plurality of structural elements, may have one or more slots, each of which having received a portion of one of the second plurality of structural elements.

In some embodiments, the slots of the first plurality of structural elements are aligned with the slots of the second plurality of structural elements. In some embodiments, for instance, each of the slots of the second plurality of structural elements extend upward from a lower edge of the second structural element and each of the slots of the first plurality of structural elements extend downward from the upper edge of the first structural element. When assembled together, therefore, each of the slots of the first plurality of structural elements may receive a portion of one of the second plurality of structural elements positioned directly above one of the slots of the second structural element and each of the slots of the second plurality of structural elements may receive a portion of one of the first plurality of structural elements positioned directly below one of the slots of the first structural element.

In some embodiments, the structural elements may be a thin, flat structure, such as may be cut from a sheet of material. For instance, each of the structural elements may have flat or substantially flat side surfaces. Each structural element may have a thickness (between the flat or substantially flat side surfaces) less than 4 inches, alternatively less than 3 inches, alternatively less than 2 inches. Each of the structural elements may have a straight lower edge extending along the longitudinal axis. The upper edge of the structural elements will depend on the desired topography of the topographical structure, e.g. mound. In most embodiments, however, one or more of the structural elements may have an upper edge that includes one or more curves. One or more of the structural elements may also optionally include a front edge and a rear edge, each of which extend vertically a desired distance.

The structural elements may be made of any of a variety of materials. In some embodiments, the structural elements may be made of plastic, such as for example high density polyethylene (HDPE). In other embodiments, the structural elements may be made of a metal, e.g. steel or aluminum, or wood or engineered wood, for example plywood, e.g. medium-density overlay (MDO) plywood, chipboard (i.e. particle board), fiberboard, e.g. medium-density fiberboard (MDF), oriented strand board (OSB), and the like. In some embodiments, environmentally durable materials such as plastics, metals, and the like may be desired in order to ensure that degradation of the structural elements over time does not result in movement of the fill material, which could result in cracking of the support layer or the like.

In some embodiments, at least one of the first plurality of structural elements is configured to be positioned with its longitudinal axis in alignment with at least one other of the first plurality of structural elements in order to produce a composite panel; at least one of the second plurality of structural elements is configured to be positioned with its longitudinal axis in alignment with at least one other of the second plurality of structural elements in order to produce a composite panel; or both. The structural elements that make up a composite panel may or may not be secured together; in fact, while it is desirable that the edges of the adjacent structural elements contact one another, it is not required. By assembling longer composite panels from multiple structural elements in this way, manufacture and shipping may be streamlined and made more economical.

In some embodiments, one or more, and desirably each, of the structural elements may have a level indicator positioned a defined distance from an upper edge of the structural element. The level indicator may take on any of a variety of forms. In some embodiments, the level indicator include one or more apertures which may optionally also be configured to serve as a handle or handles. For instance, an edge of the one or more apertures, e.g. the lower edge, may serve as the level indicator. The fill material may be present in the plurality of spaces formed by the structural framework to the height identified by the one or more level indicators. Additionally, in some embodiments, the thickness of the support layer may be substantially equivalent to the distance between the level indicator(s) and the upper edge of the structural element(s). The inclusion of one or more level indicators facilitates proper installation.

In some embodiments, one or more of the structural elements may comprise one or more apertures, any or all of which may also serve as a level indicator, and the material that makes up the support layer, e.g. concrete, may extend through the one or more apertures, thereby joining the spaces defined by adjacent structural elements and providing the topographical structure, e.g. artificial mound, with enhanced strength.

In some embodiments, the topographical structure, e.g. artificial mound, may have a playground component or portion of a playground component, e.g. part of an elevated play structure, a climbing unit, a slide, a zip-track or zip-line, an elevated spinner, a bridge, a balance beam, an overhead ladder, etc., extending from the top surface of the structure. For instance, at least a portion of the playground component, e.g. one or more posts, may extend into one or more spaces formed between adjacent structural elements of the framework. More desirably for enhanced stability, the portion of the playground component may extend through the space formed between adjacent structural elements of the framework and some distance into a hole in the ground on which the topographical structure is installed. For enhanced stability, the remainder of the space and any such ground hole may be filled with a material such as concrete. The cushion layer and, if present, finish layer may be installed directly over the concrete consistently with the surrounding portion of the structure, thereby creating a surface layer that covers the structural framework and contacts the playground component, such that the playground component projects from the surface layer of the artificial topographical structure, e.g. mound. The exact positioning of the playground component in the topographical structure may be selected as desired, with the options being virtually unlimited, and incorporated into a design for a new of modified playground. Moreover, because the structural framework can be designed to a high degree of specificity in advance and installed to create an artificial structure having a high degree of precision relative to the design, the opportunities for incorporating playground components are almost endless.

In some embodiments, the topographical structure, e.g. artificial mound, may have a tunnel extending through it. For instance, each of a plurality of adjacent structural elements may comprise an aperture sized and configured to accommodate one or more tube elements. One or more tube elements may extend through the apertures to produce the tunnel. The cushion layer and, if present, finish layer may be installed up to, but not over, the ends of the tube, such that the boundary between the tube and the surrounding portions of the topographical structure is smooth.

In some embodiments, the topographical structure, e.g. artificial mound, may comprise one or more elements configured to allow users of mobility devices, e.g. wheelchairs and the like, to access the structure. For instance, the topographical structure, e.g. artificial mound, may comprise an access element such as a ramp, a transfer system or platform, or the like. In some embodiments, the access element or a portion of the access element may be built directly into the structure. Moreover, in some embodiments, a plurality of topographical structures, e.g. artificial mounds, may be connected by one or more access elements, e.g. ramps or bridges that are accessible by a user of a mobility device such as a wheelchair, to produce an accessible pathway for play.

As shown and described herein, the topographical structures, e.g. artificial mounds, can be produced in complex forms by simply designing and producing structural elements that, together, provide a desired topography. Moreover, once a structure having a particular topography has been designed, it can be reproduced consistently across any number of playground sites. By providing structural elements that are easy to assemble together to produce a framework structure, installation of a topographical structure, e.g. artificial mound, is also significantly simplified. Finally, the structural elements and methods described herein enable the production of customized topographical structures and customized playground topographies.

Embodiments of the present disclosure are also directed to a playground comprising one or more of the artificial topographical structures, e.g. artificial mounds, described herein, optionally in which one or more of the topographical structures is integrated with one or more playground components as described herein to produce a unique play space. In some embodiments, the playground may comprise a customized topographical structure, providing the playground with a customized topography.

Embodiments of the present disclosure are also directed to sets configured to be assembled to form a structural framework for an artificial topographical structure, e.g. artificial mound, such as those described herein. The set includes a plurality of structural elements, each of which comprises first and second side surfaces, an upper edge, a lower edge, and a longitudinal axis. Each of the plurality of structural elements is configured to connect to one or more other of the plurality of structural elements at one or more predetermined points to form a framework structure, over which one or more layers may be laid to prepare the topographical structure, e.g. mound. Further, the upper edges of the plurality of structural elements are shaped to provide the topographical structure, e.g. artificial mound, with a surface having a predetermined contour.

In some embodiments, the plurality of structural elements comprises a first subset of structural elements configured to be arranged with their longitudinal axes extending in a first direction and a second subset of structural elements configured to be arranged with their longitudinal axes extending in a second direction, the second direction being transverse to the first direction. In some embodiments, the second direction may be perpendicular to the first direction so as to form a framework structure that is a grid when the first and second subsets of structural elements are connected together.

In some embodiments, the structural elements, e.g. the first subset of structural elements and the second subset of structural elements, may be configured to be connected to one another through a plurality of slots. In some embodiments, for instance, at least one of the structural elements, and desirably each of the structural elements, comprises one or more slots, each of the one or more slots being positioned at one of the predetermined points of connection with another structural element and configured to receive a portion of the structural element to which it is connected.

In some embodiments, at least one of the second subset of structural elements, and desirably each of the second subset of structural elements, may have one or more slots, each of which is configured to receive a portion of one of the first subset of structural elements. Alternatively or additionally, at least one of the first subset of structural elements, and desirably each of the first subset of structural elements, may have one or more slots, each of which is configured to receive a portion of one of the second subset of structural elements.

In some embodiments, for instance, the slots of at least one of the set of structural elements extend upward from the lower edge of the structural element and the slots of at least another of the set of structural elements extend downward from the upper edge of the structural element.

In some embodiments, the slots of the first subset of structural elements are configured to be aligned with the slots of the second subset of structural elements. In some embodiments, for instance, each of the slots of the second subset of structural elements extend upward from a lower edge of the second structural element and each of the slots of the first subset of structural elements extend downward from the upper edge of the first structural element. When assembled together, therefore, each of the slots of the first subset of structural elements may be configured to receive a portion of one of the second subset of structural elements positioned directly above one of the slots of the second structural element and each of the slots of the second subset of structural elements may be configured to receive a portion of one of the first subset of structural elements positioned directly below one of the slots of the first structural element.

In some embodiments of the set, the structural elements may be a thin, flat structure, such as may be cut from a sheet of material. For instance, each of the structural elements may have flat or substantially flat side surfaces. Each structural element may have a thickness (between the flat or substantially flat side surfaces) less than 4 inches, alternatively less than 3 inches, alternatively less than 2 inches. Each of the structural elements may have a straight lower edge extending along the longitudinal axis. The upper edge of the structural elements will depend on the desired topography of the topographical structure, e.g. mound. In most embodiments, however, one or more of the structural elements may have an upper edge that includes one or more curves. One or more of the structural elements may also optionally include a front edge and a rear edge, each of which extend vertically a desired distance.

The structural elements of the set may be made of any of a variety of materials. In some embodiments, the structural elements may be made of plastic, such as for example high density polyethylene (HDPE). In other embodiments, the structural elements may be made of a metal, e.g. steel or aluminum, or wood or engineered wood, for example plywood, e.g. medium-density overlay (MDO) plywood, chipboard (i.e. particle board), fiberboard, e.g. medium-density fiberboard (MDF), oriented strand board (OSB), and the like. In some embodiments, environmentally durable materials such as plastics, metals, and the like may be desired in order to ensure that degradation of the structural elements over time does not result in movement of the fill material, which could result in cracking of the support layer or the like.

In some embodiments, at least one of the first subset of structural elements is configured to be positioned with its longitudinal axis in alignment with at least one other of the first subset of structural elements in order to produce a composite panel; at least one of the second subset of structural elements is configured to be positioned with its longitudinal axis in alignment with at least one other of the second subset of structural elements in order to produce a composite panel; or both. The structural elements that make up a composite panel may or may not be configured to be secured together. By assembling longer composite panels from multiple structural elements in this way, manufacture and shipping may be streamlined and made more economical. For example, in some embodiments, each of the structural components within the set may have a length of eight feet or less, optionally seven feet or less, optionally six feet or less, optionally five feet or less, optionally four feet or less.

In some embodiments, the set of structural elements is configured to be stacked and shipped as a flat pack assembly.

In some embodiments, one or more, and desirably each, of the structural elements may have a level indicator positioned a defined distance from an upper edge of the structural element. The level indicator may be positioned and configured to indicate the height to which a fill material should be poured into the spaces defined by the framework structure. The level indicator may take on any of a variety of forms. In some embodiments, the level indicator include one or more apertures which may optionally also be sized and configured to receive a user's fingers, such that the one or more apertures serve as a handle. For instance, an edge of the one or more apertures, e.g. the lower edge, may serve as the level indicator.

In some embodiments, the level indicator may also be positioned a defined distance from an upper edge of the structural element in which the defined distance is equivalent to the height to which a support layer, e.g. of concrete, is to be poured. In this manner, the set may also facilitate the concrete being applied as a layer having a consistent thickness from the level indicator to the top of the framework structure.

In some embodiments, the set of structural elements may be labeled to facilitate proper assembly. For example, one or more, and desirably each, of the plurality of structural elements may be labeled to identify a predetermined position within the framework structure, e.g. grid.

In some embodiments, for instance, each of the first subset of structural elements may comprise one or more characters that identify its placement in the framework structure relative to the other structural elements within the first subset; each of the second subset of structural elements may comprise one or more characters that identify its placement in the framework structure relative to the other structural elements within the second subset, or both. The one or more characters may be of any of a variety of alphabetic, numeric, or symbolic characters. For example, the one or more characters may comprise letters, numbers, or a combination thereof. The one or more characters may be provided on the structural element in any of a variety of known techniques. In some embodiments, for instance, the one or more characters may be applied to or etched into the first side surface of the structural element, the second side surface of the structural element, or both.

In some embodiments, each of the plurality of structural elements comprises one or more characters adjacent each slot, wherein the one or more characters identifying a slot of a first structural element matches the one or more characters identifying a corresponding slot of a second structural element to which the slot of the first structural element is designed to be connected. In some embodiments, for each of the first subset of structural elements or each of the second subset of structural elements, each slot of a structural element may be identified with one or more characters that is different from the one or more characters used to identify each other slot of the structural element. The one or more characters may be of any of a variety of alphabetic, numeric, or symbolic characters. For example, the one or more characters may comprise letters, numbers, or a combination thereof. The one or more characters may be provided on the structural element in any of a variety of known techniques. In some embodiments, for instance, the one or more characters may be applied to or etched into the first side surface of the structural element, the second side surface of the structural element, or both.

In some embodiments, one or more of the structural elements of the set comprises an aperture spanning between the first and second side surfaces and configured to receive a tube or portion of a tube.

Embodiments of the present disclosure are also directed to a flat pack assembly comprising a set configured to be assembled to form a structural framework for an artificial topographical structure, e.g. artificial mound, such as those described herein.

Embodiments of the present disclosure are also directed to methods of making an artificial topographical structure, e.g. artificial mound, using a set of structural elements, each of which comprises first and second side surfaces, an upper edge, and a lower edge; in which the upper edges of the plurality of structural elements are shaped to provide the topographical structure, e.g. mound, with a surface having a predetermined contour. Embodiments of the method involves assembling a structural framework by connecting the structural elements together in a predefined manner, filling the spaces formed by the structural framework with a fill material, and applying one or more layers over top of the structural framework and/or fill material.

Embodiments of the method may also comprise providing the set of structural elements. In some embodiments, the step of providing the set of structural elements may comprise designing a plurality of structural elements using computer software and cutting the plurality of structural elements, e.g. from a sheet of material, using a computer-controlled cutting tool. In some embodiments, the step of providing the set of structural elements may also comprise shipping the plurality of structural elements, e.g. in a flat pack assembly.

Embodiments of the present disclosure are also directed to methods that include providing the set of structural elements and causing (inducing) a user, e.g. an installer, to assemble a structural framework by connecting the structural elements together in a predefined manner, fill the spaces formed by the structural framework with a fill material, and apply one or more layers over top of the structural framework and fill material. In some embodiments, the step of providing the set of structural elements may include designing a plurality of structural elements using computer software and cutting the plurality of structural elements, e.g. from a sheet of material, using a computer-controlled cutting tool. In some embodiments, the step of providing the set of structural elements may also include transporting the plurality of structural elements to an installation site, e.g. as a flat pack assembly. In some embodiments, the set of structural elements may be provided with instructions for assembling the framework structure, filling the spaces with the fill material, and/or applying the one or more layers.

In some embodiments, assembling the structural framework may comprise arranging a first subset of structural elements with their longitudinal axes extending in a first direction and arranging a second subset of structural elements with their longitudinal axes extending in a second direction, the second direction being transverse, and optionally perpendicular, to the first direction.

In some embodiments, assembling the structural framework may comprise using one or more characters present on the structural elements to arrange the structural elements in the predefined pattern. For example, each of the first subset of structural elements may comprise one or more characters that identify its placement relative to the other structural elements within the first subset, each of the second subset of structural elements may comprise one or more characters that identify its placement relative to the other structural elements within the second subset, or both. Accordingly, the step of assembling a structural framework may comprise using the one or more characters to arrange the first subset of structural elements relative to one another, using the one or more characters to arrange the second subset of structural elements relative to one another, or both. The one or more characters may be of any of a variety of alphabetic, numeric, or symbolic characters. For example, the one or more characters may comprise letters, numbers, or a combination thereof. The one or more characters may be provided on the structural element in any of a variety of known techniques. In some embodiments, for instance, the one or more characters may be applied to or etched into the first side surface of the structural element, the second side surface of the structural element, or both.

In some embodiments, assembling the structural framework may also comprise positioning at least one of the structural elements with its longitudinal axis in alignment with at least one other of the structural elements to produce a composite panel. In some embodiments, for example, at least one of the first subset of structural elements may be positioned with its longitudinal axis in alignment with at least one other of the first subset of structural elements in order to produce a composite panel; at least one of the second subset of structural elements may be positioned with its longitudinal axis in alignment with at least one other of the second subset of structural elements in order to produce a composite panel; or both. The structural elements that make up a composite panel may or may not be secured together.

In some embodiments, connecting the structural elements together may involve the use of one or more slots. For instance, at least one of the structural elements, and desirably each of the structural elements, may comprise one or more slots, each of the one or more slots being positioned at a predetermined point of connection with another structural element and configured to receive a portion of the structural element to which it is connected. In some embodiments, each of the first subset of structural elements may comprise one or more slots, each slot being positioned at a predetermined points of connection with one of the second subset of structural elements and configured to receive a portion of the structural element to which it is connected. Similarly, each of the second subset of structural elements may also comprise one or more slots, each slot being positioned at a predetermined point of connection with one of the first subset of structural elements and configured to receive a portion of the structural element to which it is connected.

In some embodiments, connecting the structural elements together may involve aligning the slots of the first subset of structural elements and the slots of the second subset of structural elements. For instance, the slots of the first subset of structural elements may extend downward from the upper edges of the structural elements and the slots of the second subset of structural elements may extend upward from the lower edges of the structural elements, or vice versa. Once the slots of a structural element from the second subset are aligned with the slots of one or more structural elements from the first subset, therefore, the structural element of the second subset may be lowered into connection with the one or more structural elements from the first subset, such that (i) the slots of the structural element from the second subset of structural elements receive portions of the one or more structural elements from the first subset immediately below the slots of the one or more structural elements from the first subset, and (ii) the slots of the one or more structural elements from the first subset of structural elements receive portions of the structural element from the second subset immediately above the slots of the structural element from the second subset.

In some embodiments, assembling the structural framework may comprise matching a character adjacent a slot of a second structural element with a character adjacent a slot of a first structural element, aligning the slot of the second structural element with the slot of the first structural element, and connecting the second structural element with the first structural element by lowering the second structural element into place as described above. For instance, each of the plurality of structural elements may comprise one or more characters adjacent each slot. In that way, for example, a structural element of the second subset may have one or more characters adjacent each of a plurality of slots, each of which identifies, through matching the character(s) adjacent a slot of a structural element from the first subset, the slot of the structural element from the first subset to which the slot of the structural element of the second subset is to be connected. The one or more characters may be of any of a variety of alphabetic, numeric, or symbolic characters. For example, the one or more characters may comprise letters, numbers, or a combination thereof. The one or more characters may be provided on the structural element in any of a variety of known techniques. In some embodiments, for instance, the one or more characters may be applied to or etched into the first side surface of the structural element, the second side surface of the structural element, or both.

In some embodiments, each of the structural elements used to assembly the framework may be a thin, flat structure, such as may be cut from a sheet of material. For instance, each of the structural elements may have flat or substantially flat side surfaces. Each structural element may have a thickness (between the flat or substantially flat side surfaces) less than 4 inches, alternatively less than 3 inches, alternatively less than 2 inches. Each of the structural elements may have a straight lower edge extending along the longitudinal axis. The upper edge of the structural elements will depend on the desired topography of the topographical structure, e.g. mound. In most embodiments, however, one or more of the structural elements may have an upper edge that includes one or more curves. One or more of the structural elements may also optionally include a front edge and a rear edge, each of which extend vertically a desired distance.

The structural elements used to assemble the framework may be made of any of a variety of materials. In some embodiments, the structural elements may be made of plastic, such as for example high density polyethylene (HDPE). In other embodiments, the structural elements may be made of a metal, e.g. steel or aluminum, or wood or engineered wood, for example plywood, e.g. medium-density overlay (MDO) plywood, chipboard (i.e. particle board), fiberboard, e.g. medium-density fiberboard (MDF), oriented strand board (OSB), and the like.

In some embodiments, the fill material may be crushed stone. In some embodiments, the one or more layers may comprise or consist of a support layer, e.g. concrete or the like, and a cushion layer, e.g. poured-in-place rubber or the like. In some embodiments, the one or more layers may further comprise a finish layer, e.g. of a cap layer of poured-in-place rubber, synthetic grass, turf, or the like.

In some embodiments, one or more of the structural elements, and optionally each of the structural elements, may have a level indicator a defined distance from the upper edge, and the step of filling the spaces formed by the structural framework with a fill material may comprise adding the fill material to the spaces to a height that corresponds or substantially corresponds (taking into account that the height of the fill material may not be completely consistent across each of the spaces) with the level indicator(s). In some embodiments, the level indicator may comprise one or more apertures, which may also be sized and configured to receive a user's fingers, such that the one or more apertures serve as a handle.

In some embodiments, the step of applying one or more layers over top of the structural framework and/or fill material may comprise applying a support layer, optionally concrete, into the spaces and on top of the fill layer. In some embodiments, the support layer may be applied until the support layer is substantially level with the upper edges of the plurality of structural elements. In some embodiments, one or more of the structural elements, and optionally each of the structural elements, may have a level indicator a defined distance from the upper edge, and the step of applying the support layer may comprise filling the spaces between the level indicator(s) and the upper edges of the structural elements. In some embodiments, one or more of the structural elements may comprise one or more apertures, any or all of which may also serve as a level indicator, and the material that makes up the support layer, e.g. concrete, may flow through the one or more apertures, thereby joining the spaces defined by adjacent structural elements and providing the topographical structure, e.g. artificial mound, with enhanced strength.

In some embodiments, the method may further comprise, prior to filling the spaces formed by the structural framework with a fill material, mounting a playground component such that a portion of the playground component extends into one or more of the spaces formed by the structural framework, and optionally the portion of the playground component may extend through the one or more spaces formed between adjacent structural elements of the framework and some distance into a hole in the ground on which the topographical structure is installed. Alternatively, the structural framework may be assembled around a portion of the playground component.

For enhanced stability, the remainder of the space into (and optionally through) which the portion of the playground component extends and any such ground hole may then be filled with a material such as concrete. The concrete may be filled to the same level as the support layer, e.g. in substantial alignment with the upper edges of the structural elements, to create a consistent surface for application of and additional layers, e.g. a cushion layer.

The cushion layer and, if present, finish layer may be applied directly over the concrete consistently with the surrounding portion of the structure, thereby creating a surface layer that covers the structural framework and spans up to and into contact with the playground component, such that the playground component projects from the surface layer of the artificial topographical structure, e.g. mound.

In some embodiments, the method may further comprise forming a tunnel through the topographical structure, e.g. artificial mound, by, prior to filling the spaces formed by the structural framework with a fill material, inserting one or more tube elements through one or more apertures that are present in one or more of the structural elements. The cushion layer and, if present, finish layer may be installed up to, but not over, the ends of the tube, such that the boundary between the tube and the surrounding portions of the topographical structure is smooth.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Embodiments of the present disclosure are directed to artificial topographical structures, such as artificial mounds 100, and to the structural frameworks 10 used to produce those structures. The structural frameworks 10 may be designed, assembled, and oriented in any of a variety of different configurations, to produce topographical structures, e.g. mounds 100, having a variety of different shapes, heights, etc., without departing from the scope of the present invention. However, a first embodiment of an framework structure 10 according to the present disclosure is illustrated in FIGS. 1-5.

Figure 1:
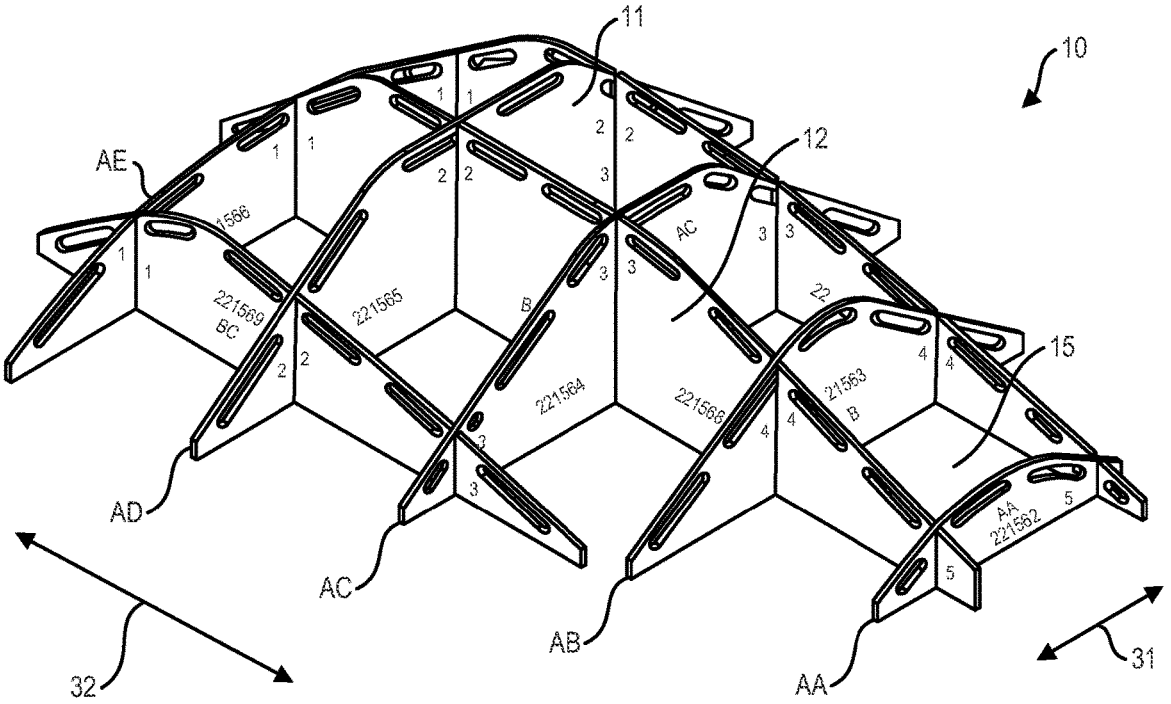
FIG. 1 is a perspective view of a first embodiment of a framework structure for an artificial mound, showing the placement of the "A" panels.
Figure 2:
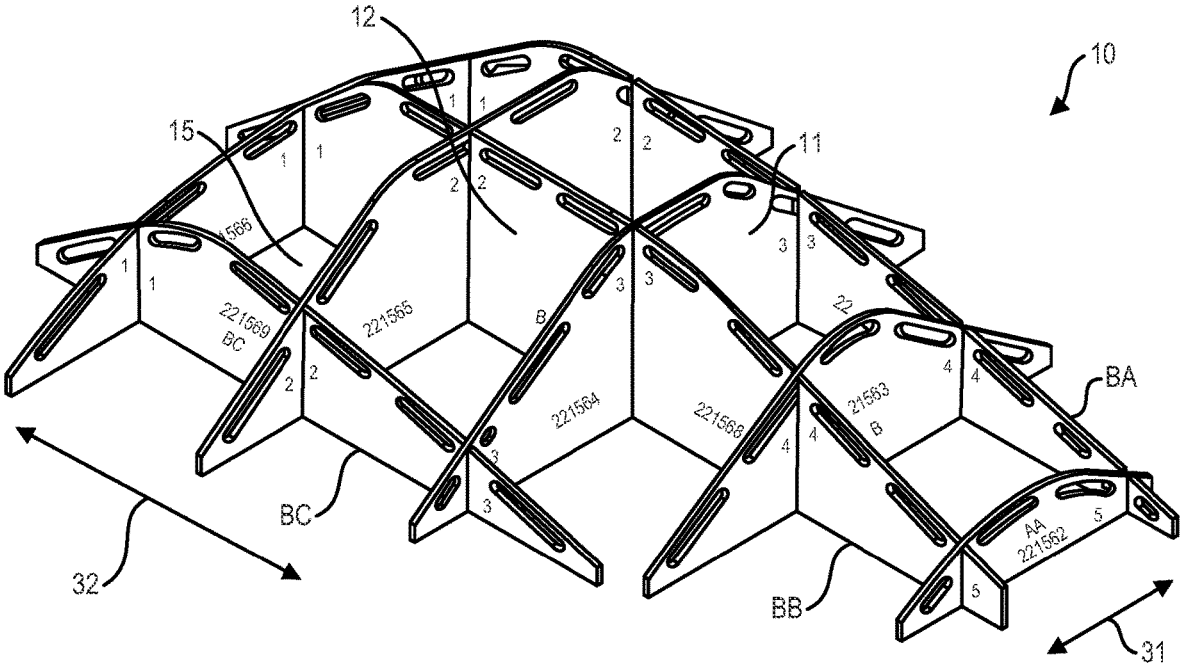
FIG. 2 is a perspective view of the embodiment illustrated in FIG. 1, showing the placement of the "B" panels.
Figure 3:
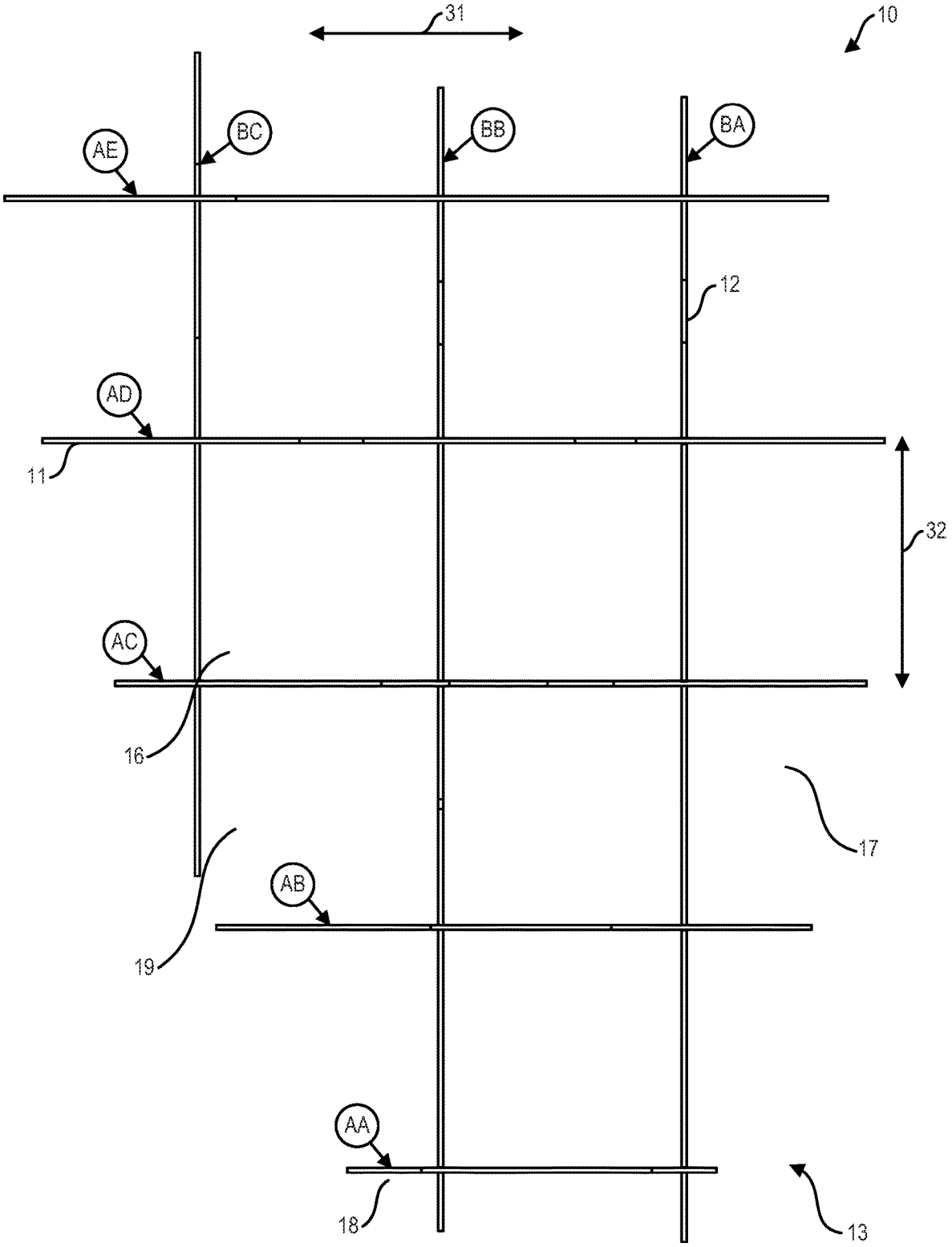
FIG. 3 is a top plan view of the embodiment illustrated in FIG. 1.
Figure 4:
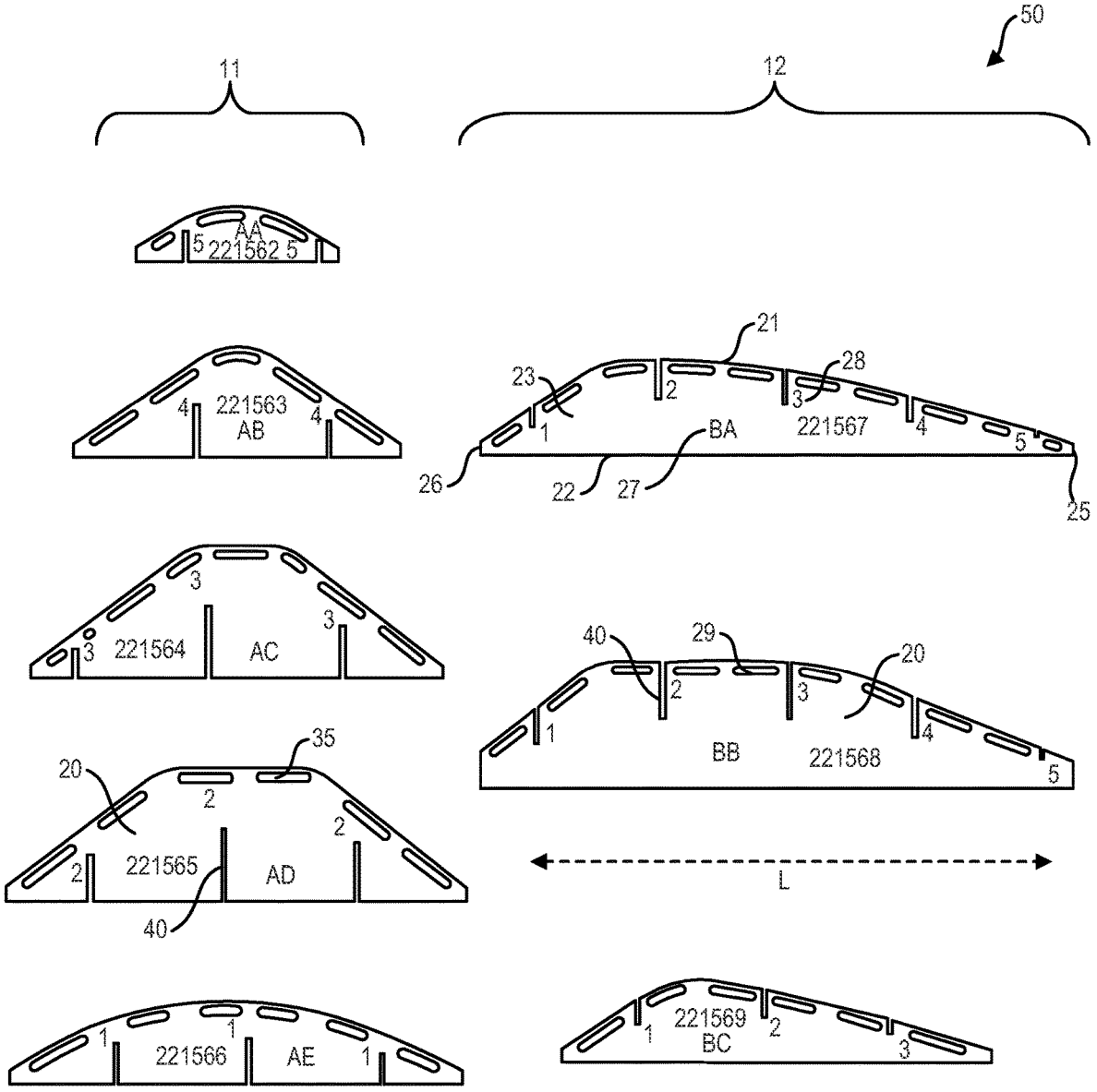
FIG. 4 is an elevation view of the structural elements that are assembled to produce the embodiment illustrated in FIG. 1.

As illustrated, the framework structure 10 comprises a plurality, or set, of individual structural elements 20. More particularly, the set of individual structural elements may be divided into two groups, or subsets: a first subset 11 of structural elements 20 identified as "A" panels (e.g. AA, AB, AC, AD, AE) and a second subset 12 of structural elements identified as "B" panels (e.g. BA, BB, BC). The "A" panels 11 are arranged with their longitudinal axes extending in a first direction 31, e.g. as shown in FIG. 1, and the "B" panels 12 are arranged with their longitudinal axes extending in a second direction 32, e.g. as shown in FIG. 2. The second direction 32 is transverse to the first direction 31. In the illustrated embodiment, for instance, the second direction 32 is perpendicular to the first direction 31, such that the "A" panels 11 and the "B" panels 12 are arranged in a grid 13, best seen in FIG. 3. In other embodiments, however, the first direction 31 and the second direction 32 may not be perpendicular. The "A" panels 11 and the "B" panels 12 are connected to one another in order to form structural framework 10.

The structural elements that are used to produce the framework 10 are supplied as a set 50 of individual panels 20. Each of the panels 20 comprises an upper edge 21, a lower edge 22, a first side surface 23, and a second side surface 24. The upper edge 21 and the lower edge 22 run along a longitudinal axis, L, of the panel 20. In some embodiments, one or more of the panels 20 may also comprise a front edge 25, a rear edge 26, or both. One or more of the panels 20 may also be configured such that the upper edge 21 runs directly into the lower edge 22, thus eliminating the front edge 25, the rear edge 26, or both. In some embodiments, one or more of the panels 20 may be an element 65 of a composite panel 60 as described in more detail below, e.g. with respect to the embodiments shown in FIGS. 8-13 and 14-19.

The lengths and shapes of the panels 20 are determined by the dimensions and desired contour of the resulting artificial structure, e.g. mound 100. In particular, the upper edges 21 of the panels 20 will vary such that, when assembled together and coated with one or more layers, the structural framework 10 produces an artificial topographical structure having a predetermined, defined contour. In the embodiment shown in FIGS. 1-5, for example, the upper edges 21 of some of the panels 20, e.g. those identified as AC, AD, and BB, comprise a first inclined portion, a horizontal or substantially horizontal central portion (of varying lengths), and a second inclined portion. Other panels 20, e.g. those identified as AA, Aft AE, BA, and BC, have an upper edge 21 with a rounded or substantially rounded interface between the first inclined portion and the second inclined portion. The flatter the upper edges 21 of the panels 20, the flatter the top surface of the artificial mound 100 will be. Conversely, the more rounded the upper edges 21 of the panels 20, the more rounded the top surface of the artificial mound will be. As illustrated in other embodiments, significantly more complex contours can also be produced using combinations of panels 20 having more varied upper edges 21.

The presence and, if present, height of the front and/or rear edges 25, 26 may also be determined by the dimensions and contour of the resulting artificial structure, e.g. mound 100.

Figure 22:
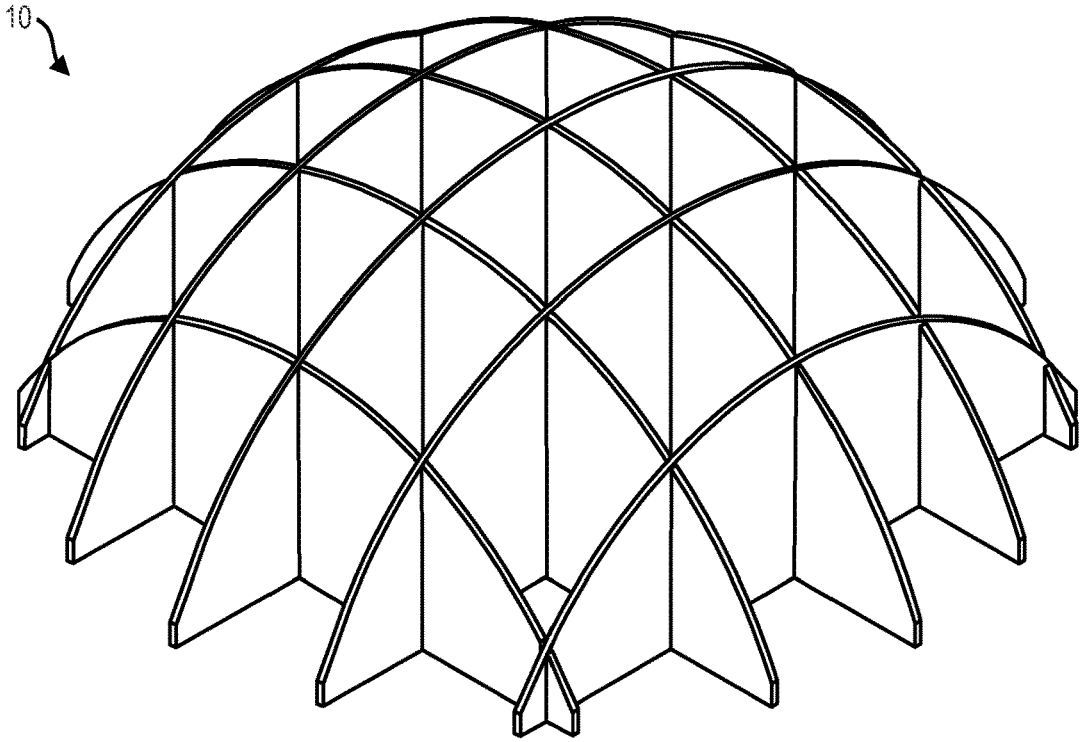
FIG. 22 is a perspective view of a sixth embodiment of a framework structure for an artificial mound, in which the structural elements have a first rise height.
Figure 23:
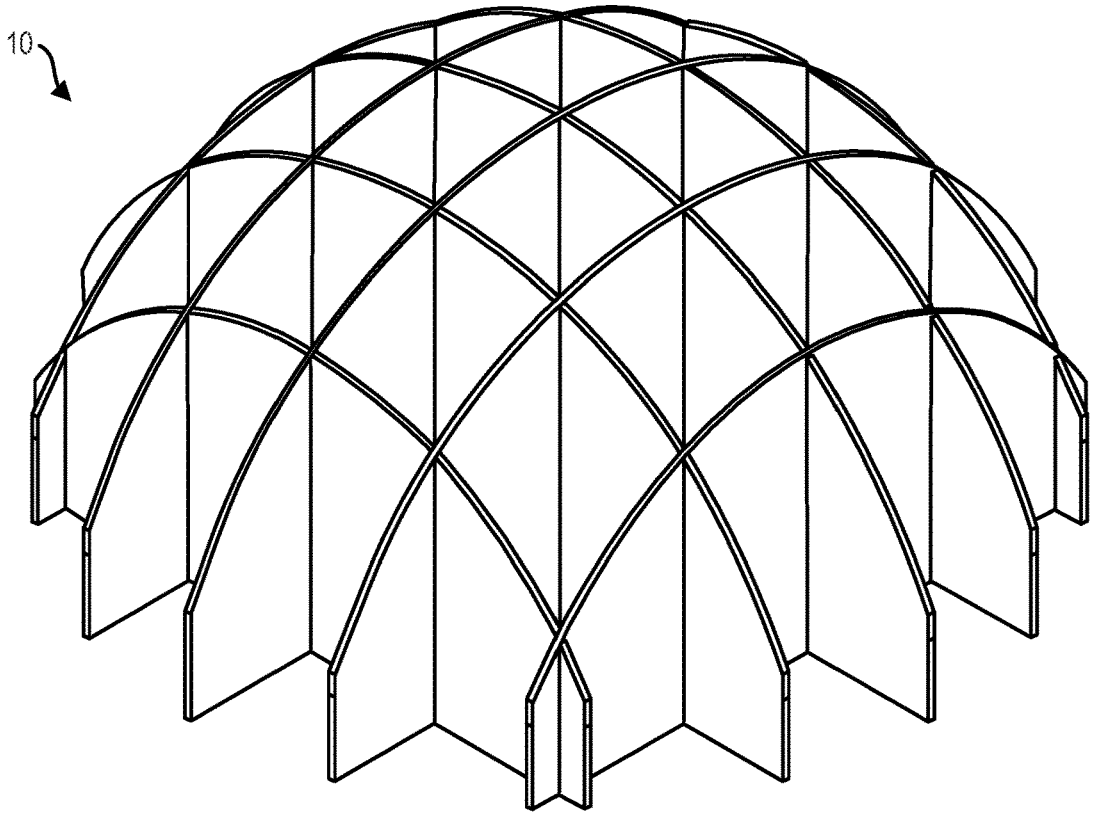
FIG. 23 is a perspective view of the embodiment illustrated in FIG. 22, in which the structural elements have a second rise height.
Figure 24:
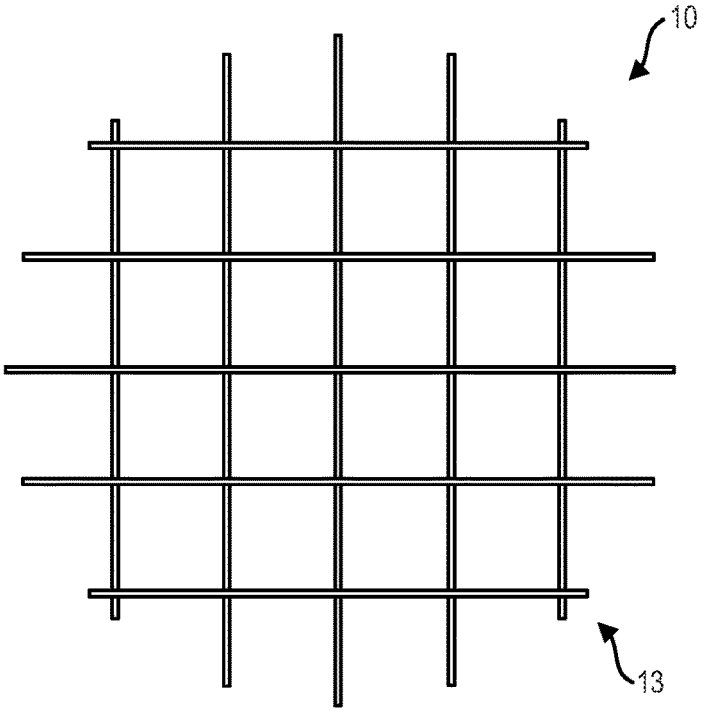
FIG. 24 is a top plan view of the embodiment illustrated in FIG. 22.

In some embodiments, the front and rear edges 25, 26 of the panels 20 may be selected to define a rise height of the topographical structure, e.g. mound 100. As best illustrated by FIGS. 22-24, for example, an artificial mound 100 may be designed to have a desired height by controlling the height of the front and/or rear edges 25, 26 of one or more of the panels 20. A first example of an embodiment of a structural framework 10 for an artificial mound is illustrated in FIG. 22. In that example, each of panels 20 has a front edge 25 and rear edge 26 that runs vertically about two inches. A second example of that an embodiment of a structural framework 10 for an artificial mound having the same configuration is illustrated in FIG. 23. In that example, however, each of panels 20 has a front edge 25 and a rear edge 26 that runs vertically about nine inches. Though the structural framework 10 in the second example has the same design and layout of panels 20 as that of the first example, as best reflected by the common upper plan view illustrated in FIG. 24, the result is an artificial mound 100 having a greater height. By varying the rise height of the structural framework 10, a particular mound design may be altered to provide a desirable height without increasing or decreasing the configuration or footprint of the structural framework.

Figure 25:
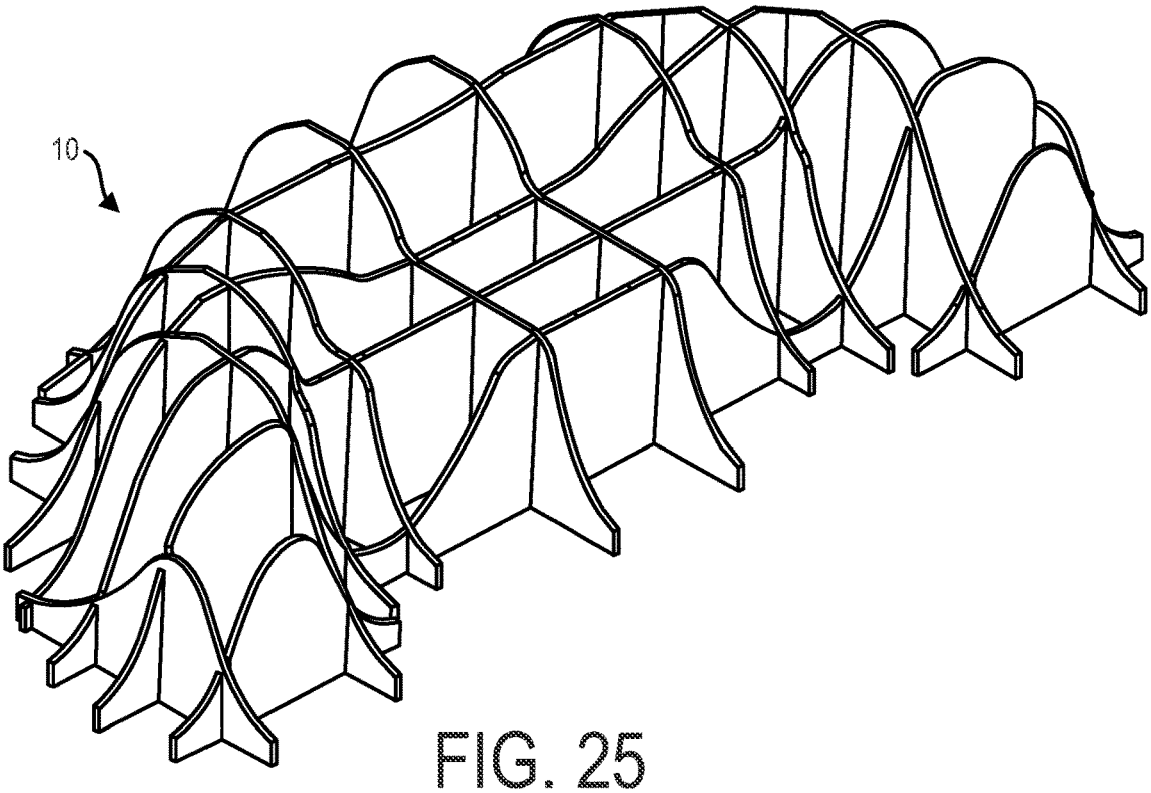
FIG. 25 is a perspective view of a seventh embodiment of a framework structure for an artificial mound, in which the structural elements have a first rise height.
Figure 26:
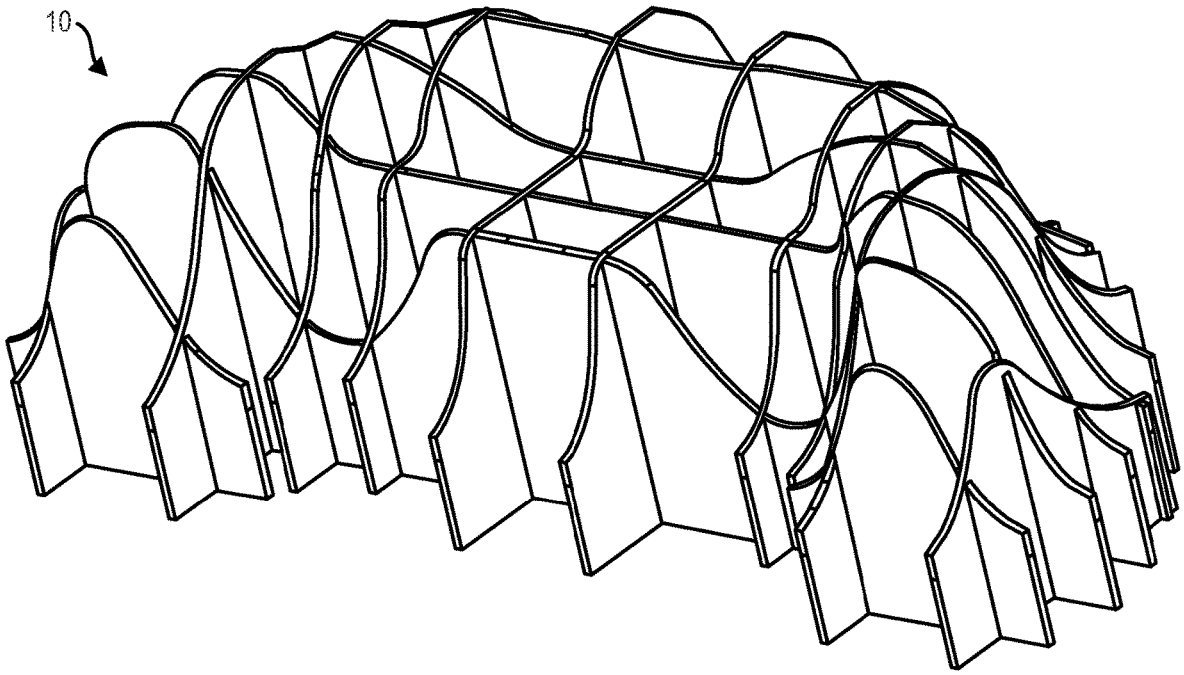
FIG. 26 is a perspective view of the embodiment illustrated in FIG. 25, in which the structural elements have a second rise height.
Figure 27:
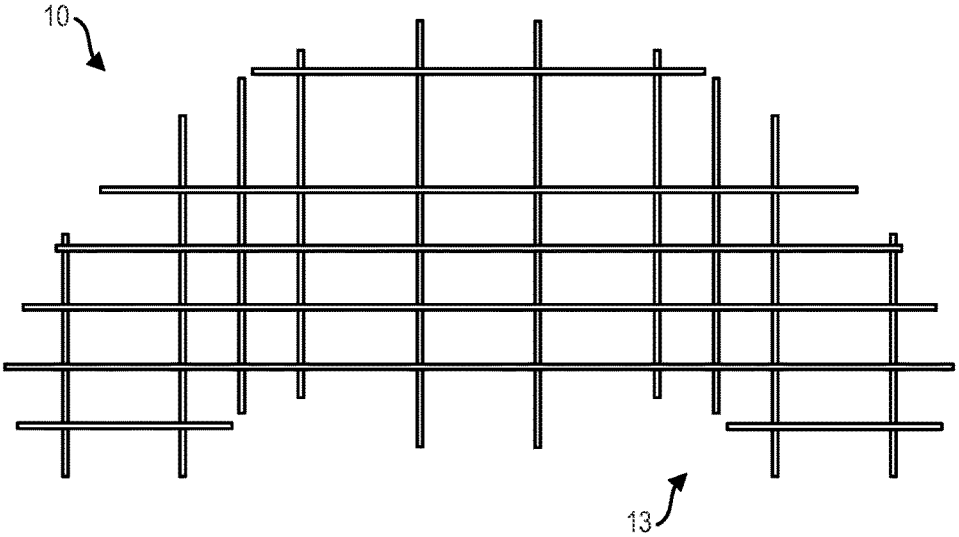
FIG. 27 is a top plan view of the embodiment illustrated in FIG. 25.
Figure 28:
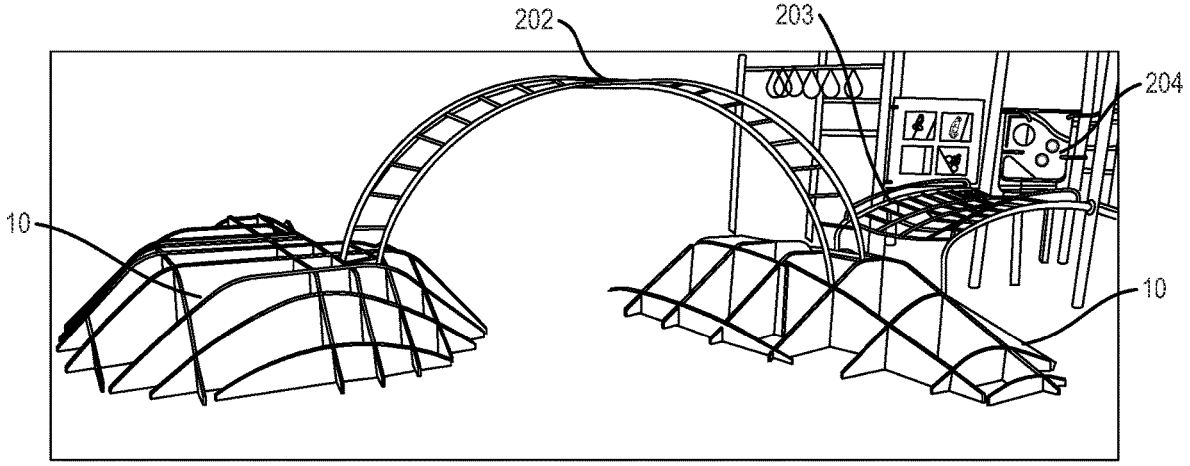
FIG. 28 is a perspective view of an unfinished playground comprising structural frameworks for multiple embodiments of artificial mounds in accordance with the present disclosure, each of which has one or more playground components incorporated therein.

The same concept may apply to more complex structures as well. As another example, an embodiment of a structural framework 10 for an artificial mound having a crescent shape and a more complex contoured surface is illustrated in FIGS. 25-26. As with the embodiment shown in FIGS. 22-24, two examples having different rise heights are illustrated. A first example of an embodiment of a structural framework 10 for an artificial mound is illustrated in FIG. 25. In that example, each of panels 20 has a front edge 25 and rear edge 26 that runs vertically about two inches. A second example of that an embodiment of a structural framework 10 for an artificial mound having the same configuration is illustrated in FIG. 26. In that example, however, each of panels 20 has a front edge 25 and a rear edge 26 that runs vertically about nine inches. Though the structural framework 10 in the second example has the same design and layout of panels 20 as that of the first example, as best reflected by the common upper plan view illustrated in FIG. 27, the result is again an artificial mound 100 having a greater height.

While these examples show structural frameworks 10 in which the height of the front and rear panels 25, 26 is consistent among the plurality of panels 20, in some designs, the height of those portions of each of the panels may not be the same. For example, in FIG. 4, the height of the rear edge 26 of panel BB is a good bit greater than the height of either the rear or front edges 25, 26 of panel BA. Accordingly, when varying the rise height of an artificial mound 100 produced using the embodiment of a structural framework 10 shown in FIGS. 1-5, the result will not be a consistent rise height such as the two inches or nine inches described for the above examples. However, in order to maintain the same essential contour, the height of each of the front and rear edges 25, 26 of all of the panels 20 may be increased or decreased by the same amount to vary the rise height of the framework 10.

In other embodiments, the height of only a portion of a structural framework 10 may be varied, though the result of such a modification is a topographical structure having a different contour, which should thus be considered the design of a different embodiment rather than a mere rise height adjustment.

Generally, the lower edge 22 of each of the panels 20 may be straight, such that the lower edge of each panel rests on a horizontal, e.g. flattened, ground surface when the structural framework 10 is assembled. In some instances, however, the lower edge 22 of one or more of the panels may also be determined by site conditions. In some embodiments, for instance, the lower edge 22 of one or more of the panels 20 may be provided with a different shape in order to account for a particular site ground feature.

Other aspects of the panels 20 may be defined by their manner of production. In some embodiments, including the illustrated embodiments, each of the panels 20 may be cut from a sheet of material 300. Accordingly, the first side surface 23 and the second side surface 24 may be flat or substantially flat (taking into account deviations in the sheet material). The panels 20 may also have any of a variety of thicknesses, as measured between the first side surface 23 and the second side surface 24. In the illustrated embodiments, the panels 20 may each be relatively thin. For instance, the panels 20 may have a thickness less than four inches, alternatively less than three inches, alternatively less than two inches, alternatively less than one inch. In some embodiments, for instance, the panels 20 may be about ½-inch thick. While a degree of structural integrity is needed, the use of thinner panels 20 reduces material costs.

The panels 20 may be made of any of a variety of materials. In some embodiments, the panels 20 may be made of plastic, such as for example high density polyethylene (HDPE). In other embodiments, however, the panels 20 may be made of a metal, e.g. steel or aluminum, or wood or engineered wood, for example plywood, e.g. medium-density overlay (MDO) plywood, chipboard (i.e. particle board), fiberboard, e.g. medium-density fiberboard (MDF), oriented strand board (OSB), and the like. The use of plastic, such as HDPE, has been found to be particularly desirable in terms of cost, manufacturability, and the ability of the material to withstand environmental conditions without structural degradation.

Each of the panels 20 may also include one or more connection elements, such as slots 40. As shown in the illustrated embodiments, each of the slots 40 is located at one of the predetermined points of intersection with another panel. Each of the slots 40 of a particular panel 20 is also configured to receive a portion of another panel 20 to which the particular panel is to be connected. For example, each of the "A" panels 11 may have one or more slots 40, each of which is positioned and configured to receive a portion of one of the "B" panels 12. Alternatively or additionally, each of the "B" panels 12 may have one or more slots 40, each of which is positioned and configured to receive a portion of one of the "A" panels 11.

In the illustrated embodiments, for example, one or more of the panels 20 has slots 40 extending downward from the upper edge 21 and one or more of the panels as slots extending upward from the lower edge 22. More particularly, each of the "B" panels 12 has one or more slots 40 extending downward from the upper edge 21 and each of the "A" panels 11 has one or more slots 40 extending upward from the lower edge 22. That said, the opposite arrangement, in which each of the "A" panels 11 has one or more slots 40 extending downward from the upper edge 21 and each of the "B" panels 12 has one or more slots 40 extending upward from the lower edge 22 would function in the same manner. By providing the panels 20, and more particularly the first and second subsets 11, 12 of panels, with complementary and cooperating slots 40 in this manner, the panels may be easily assembled together to produce the structural framework 10.

Figure 5:
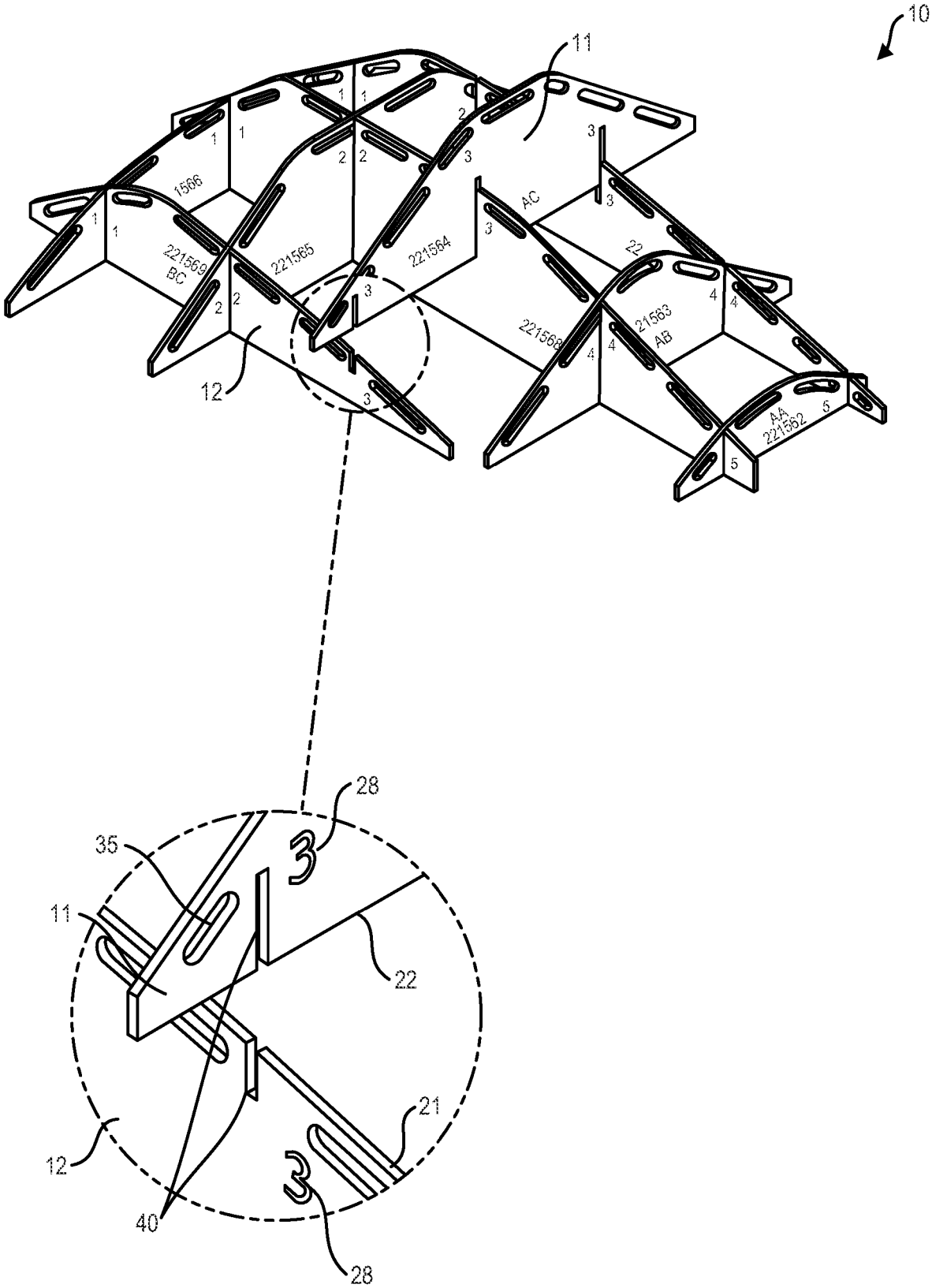
FIG. 5 is a perspective view of the embodiment illustrated in FIG. 1, showing the assembly of the "B" panels to the "A" panels.

The manner in which the panels 20 are assembled is illustrated in FIG. 5. As illustrated, one of the "A" panels 11, labeled as panel AC, has three slots 40 extending upward from its lower edge 22. Each of the slots is positioned at the point of intersection with one of the "B" panels 12, specifically those labeled as BA, BB, and BC. Each of the "B" panels 12 has a complementary slot 40 extending downward from its upper edge 21 at a corresponding location. Accordingly, in order to add the AC to the structural framework 10, an installer must simply align the slots of the AC panel with the complementary slots of the three "B" panels and then lower the AC panel into place, such that (i) each slot of the AC panel receives a portion of one of the "B" panels directly below the slot of the "B" panel and (ii) the corresponding "B" panel slot receives a portion of the AC panel directly above the slot of the AC panel. When connected together, the lower edge 22 of the AC panel and the lower edges of each of the "B" panels to which it is connected are desirably positioned in the same plane. Each of the other "A" panels 11, here labeled AA, Aft AD, and AE, are added to the structural framework 10 in the same manner.

Although a system of complementary slots 40 is shown and described in the illustrated embodiments, other manners of assembling the panels 20 together are also contemplated without departing from the scope of the invention.

In some embodiments, including many of the illustrated embodiments, each of the panels 20 may be labeled to identify its position within the structural framework 10. For example, each of the first subset of panels 11 may be labeled with one or more characters 27 that identify its placement relative to the other panels 20 within the first subset. In the embodiment shown in FIGS. 1-5, for example, each of the "A" panels is labeled with a two-letter code, the first letter being an "A" to identify the panel as being part of the first subset 11 and the second letter being one of A, B, C, D, and E, which identifies the position of each "A" panel relative to each other "A" panel.

Similarly, each of the second subset of panels 12 may be labeled with one or more characters 27 that identify its placement relative to the other panels 20 within the second subset. In the embodiment shown in FIGS. 1-5, for example, each of the "B" panels is labeled with a two-letter code, the first letter being a "B" to identify the panel as being part of the second subset 12 and the second letter being one of A, B, and C, which identifies the position of each "B" panel relative to each other "B" panel. By providing characters 27 in this manner, proper assembly of the structural framework 10 is facilitated.

Although the illustrated embodiments use letters as the characters 27, any identifying characters may be used, including one or more letters, one or more numbers, or a combination thereof. Moreover, though the illustrated embodiments show the characters 27 as being etched into at least one sidewall 23, 24 (and more desirably both sidewalls) of the panel 20, the characters may be provided by any conventional manner, e.g. etching, printing, adhesive, etc.

In some embodiments, including many of the illustrated embodiments, each of the panels 20 may be labeled to provide a visual indicator that the one or more slots 40 have been properly aligned with the slot(s) or one or more connected panels, i.e. that the panel is being or has been added to the framework structure 10 in the proper location and orientation. In the embodiment illustrated in FIGS. 1-5, for example, each panel 20 has a character 28, here a numerical character, adjacent each slot 40. When the panels 20 are assembled correctly, the character 28 adjacent each slot 40 of a particular panel matches the character adjacent the corresponding slot of a panel to which the particular panel is connected. By providing matching characters 28 in this manner, proper assembly of the structural framework 10 is facilitated.

Although the illustrated embodiments use a single number as the characters 28, any identifying characters may be used, including one or more letters, one or more numbers, one or more shapes, or a combination thereof. Moreover, though the illustrated embodiments show the characters 28 as being etched into at least one sidewall 23, 24 (and more desirably both sidewalls) of the panel 20, the characters may be provided by any conventional manner, e.g. etching, printing, adhesive, etc.

In some embodiments, including a number of the illustrated embodiments, each of the panels 20 may include a level indicator 29 a defined distance from the upper edge 21. The level indicator 29 provides a visual indication of a height to which a fill material is to be provided.

The level indicator 29 may take on any of a variety of configurations. In the embodiment illustrated in FIGS. 1-5, for example, the level indicator 29 may comprise one or more, and desirably a plurality of apertures 35. As illustrated, the apertures 35 may serve a variety of purposes. First, the lower edge of the apertures 35 serves as the level indicator 29, meaning that a fill material should be provided to a height that substantially corresponds with the lower edge of the apertures. Second, the apertures 35 are sized and configured to receive a user's fingers, such that the apertures serve as handles by which an installer may easily grip the panel 20, move it to its proper position, and incorporate it into the structural framework 10. Third, the material, e.g. concrete, used to prepare the support layer may flow through the apertures 35, thereby creating a more integrated and stronger support layer (without the support layer being applied over the top of the panels 20). In other, non-illustrated embodiments, the panels 20 may include independent level indicators 29 and apertures 35, which together achieve a combination of these functions. In yet other embodiments, the panels 20 may include one or more apertures 35 but no level indicator 29 and vice versa.

Another embodiment of a structural framework 10 for an artificial topographical structure, e.g. mound 100 is shown in FIGS. 8-12. Many of the features described with respect to the embodiment illustrated in FIGS. 1-5 are the same and are thus not described again. One difference, however, is the use of composite panels 60. A composite panel 60 is a panel that is not a single, integral element. In the embodiment illustrated in FIGS. 1-5, each of the "A" panels and each of the "B" panels is a single, integral element. In the embodiment illustrated in FIGS. 8-12, however, a number of both the "A" panels 11 and the "B" panels 12 are made up of multiple independent elements 65 placed adjacent one another with their longitudinal axes in alignment.

Rather than have a front edge and a rear edge 25, 26 that relate to a particular rise height (or having the upper edge 21 converge with the lower edge 22 at the front and rear ends of the panel 20, e.g. to produce a rise height of zero), each of independent elements 65 may instead comprise at least one edge 61 having a height that is configured to match or substantially match an edge 61 of another element 65 with which it is to be placed in adjacent alignment with to produce a composite panel 60.

Figure 11:
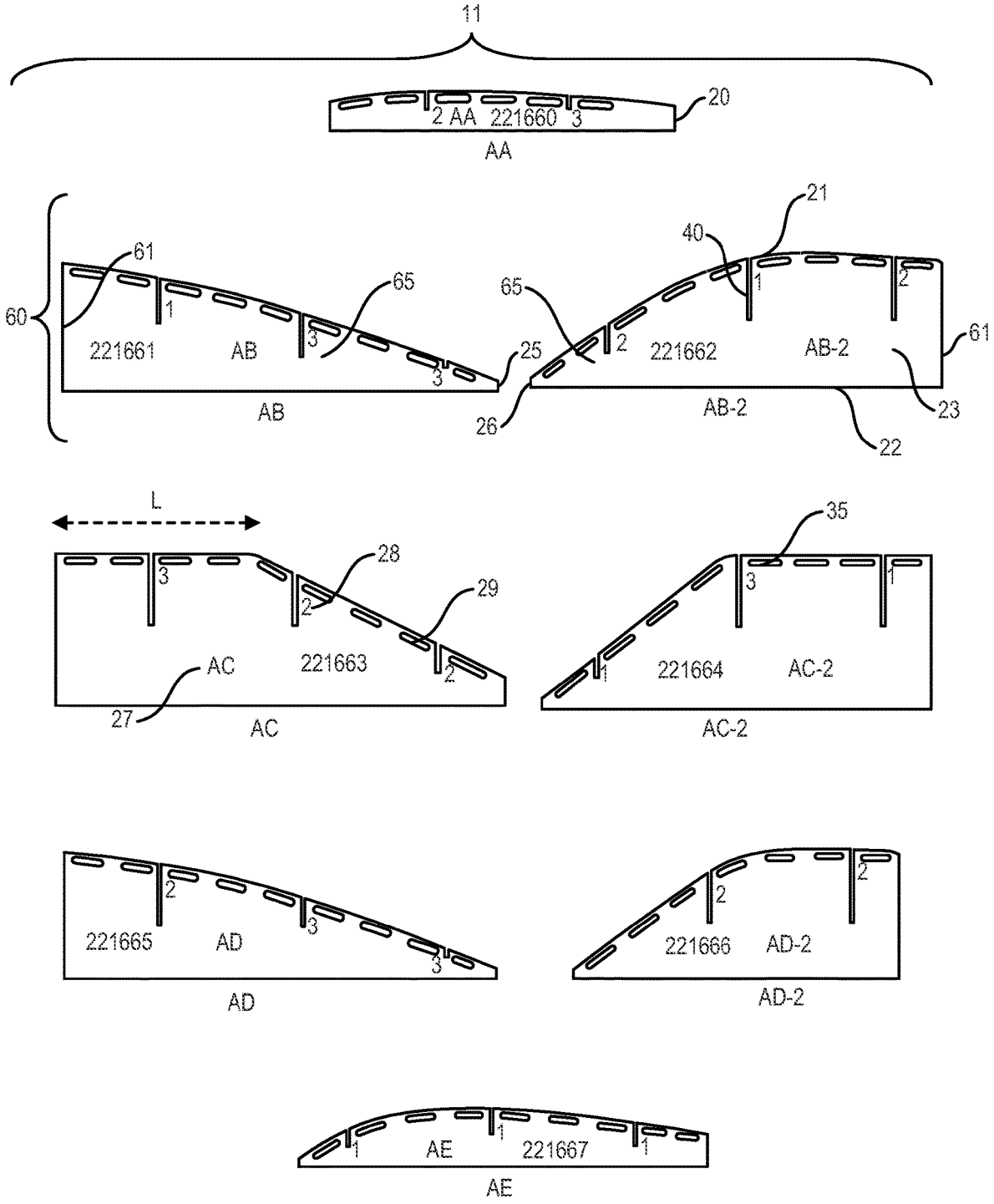
FIG. 11 is an elevation view of the "A" panel structural elements that are assembled to produce the embodiment illustrated in FIG. 8.

An example of independent elements 65 that, together, make up a composite "A" panel 60 are shown in FIG. 11. For instance, the composite panel 60 identified as AB is shown as having two distinct elements 65, a first element identified as AB and a second element identified as AB2. Each of the distinct elements 65 has an edge 61 that is configured to match or substantially match the edge of an adjacent element 65. In this illustration, note that the edges 61 of the elements 65 (e.g. AB and AB2) that would be placed adjacent each other to form the composite panel 60 are shown facing away from each other. Similarly, the composite panels 60 identified as AC and AD are each made up of two distinct elements (AC, AC2 and AD, AD2 respectively).

Figure 12:
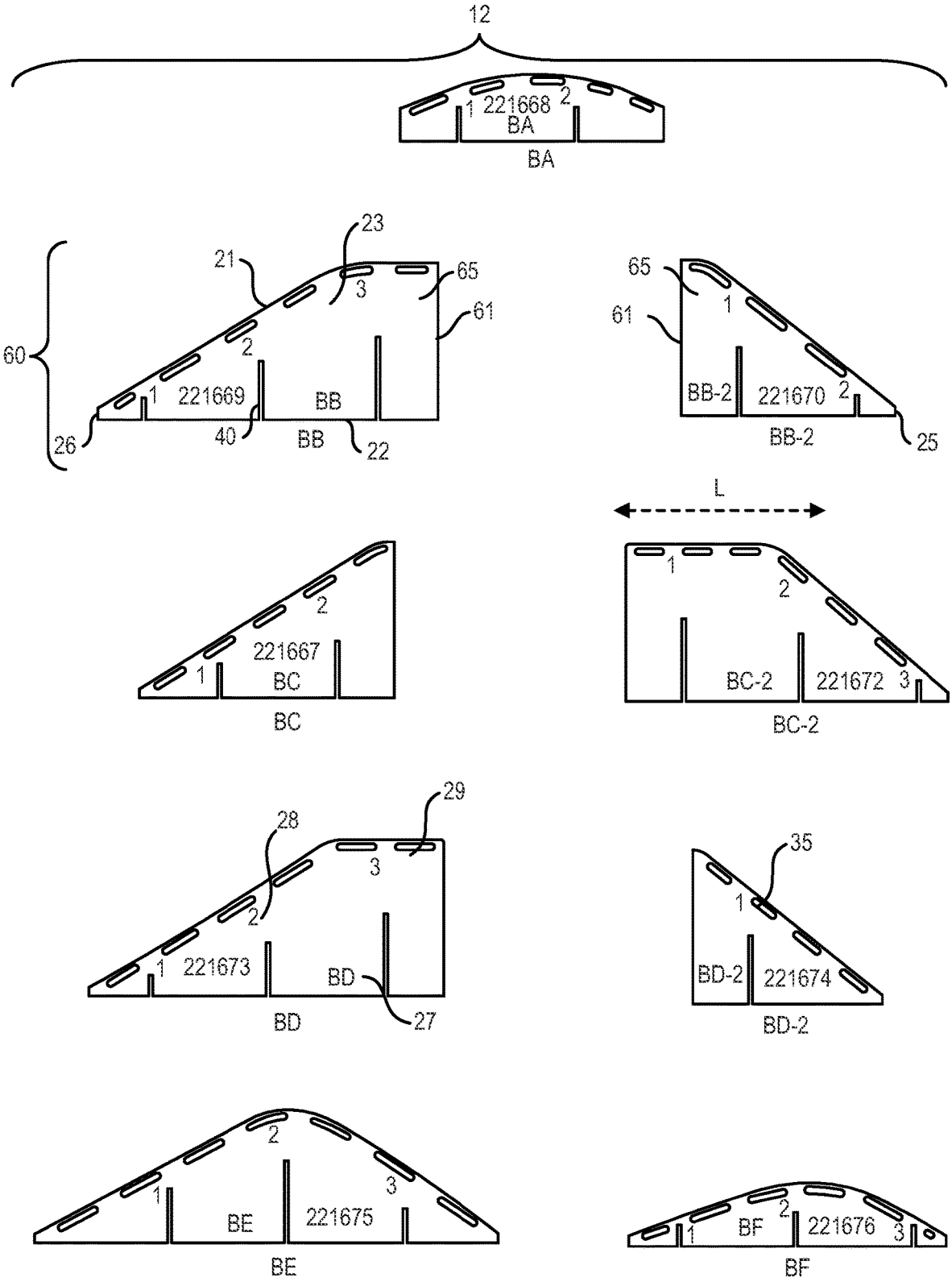
FIG. 12 is an elevation view of the "B" panel structural elements that are assembled to produce the embodiment illustrated in FIG. 8.
Figure 13:
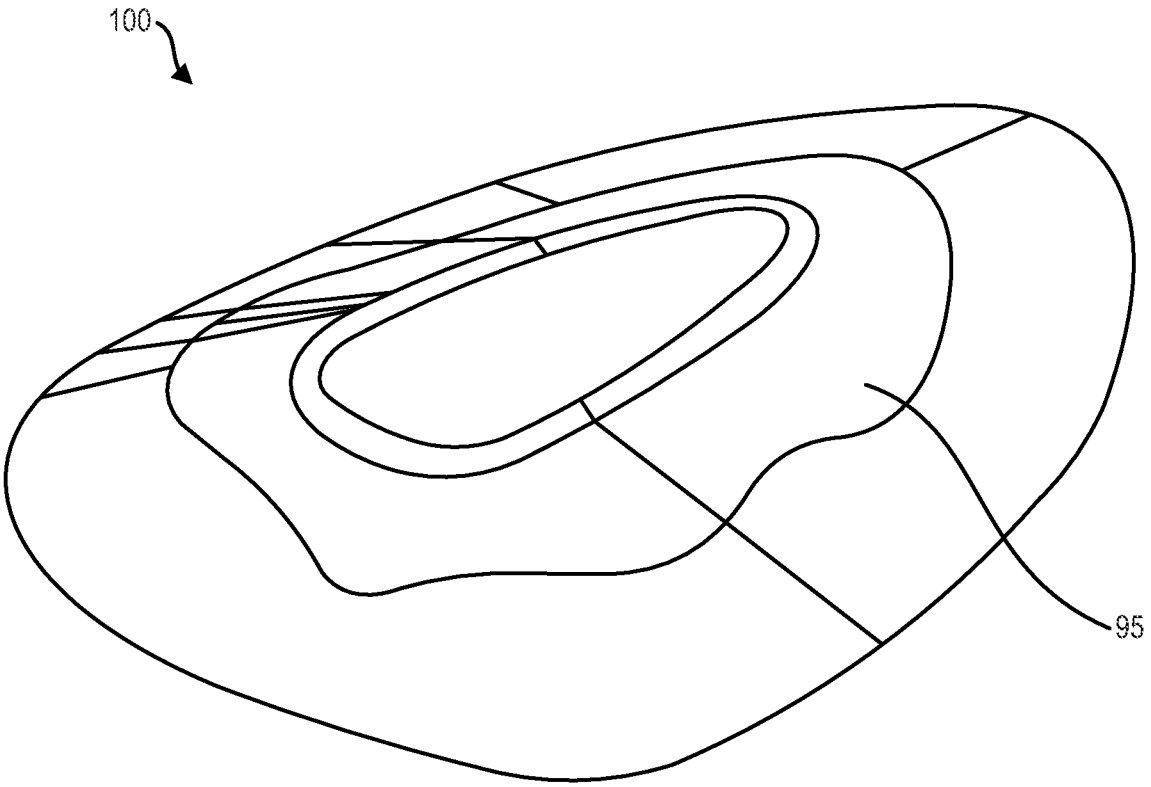
FIG. 13 is a perspective view of an artificial mound produced with the structural framework illustrated in FIG. 8.
Figure 14:
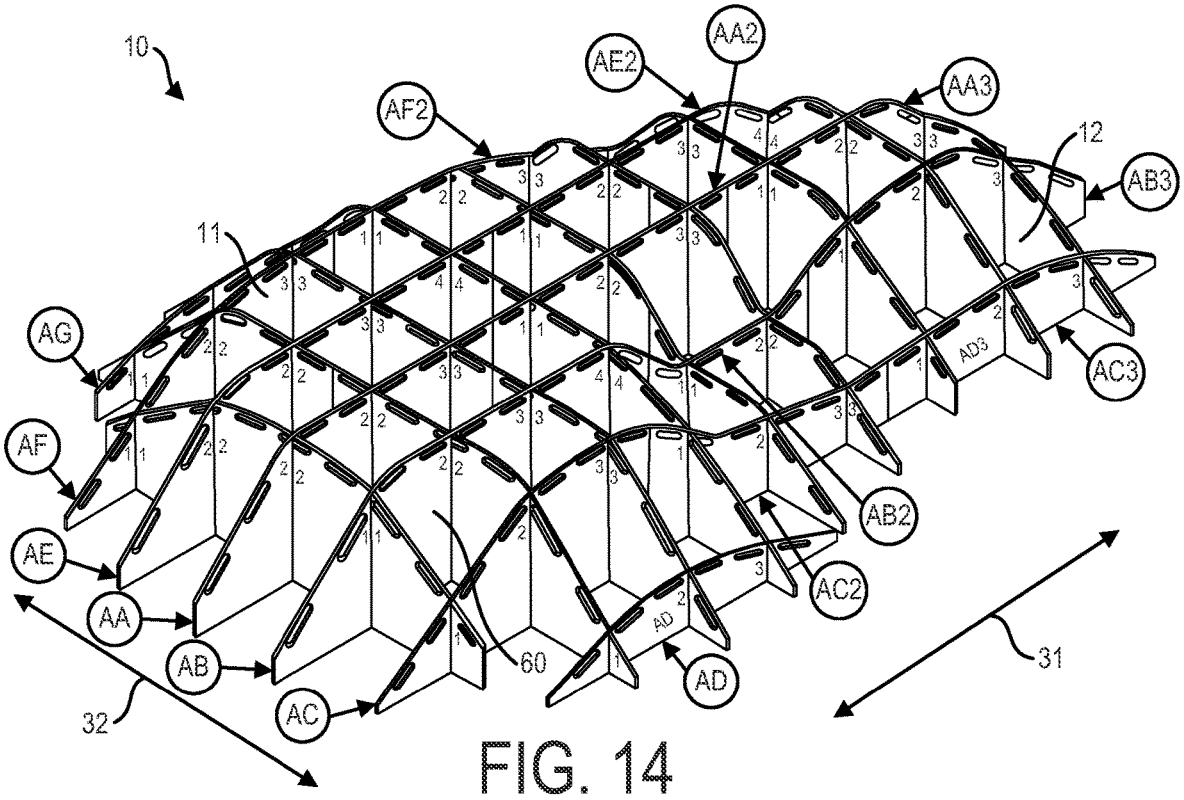
FIG. 14 is a perspective view of a third embodiment of a framework structure for an artificial mound, showing the placement of the "A" panels.
Figure 15:
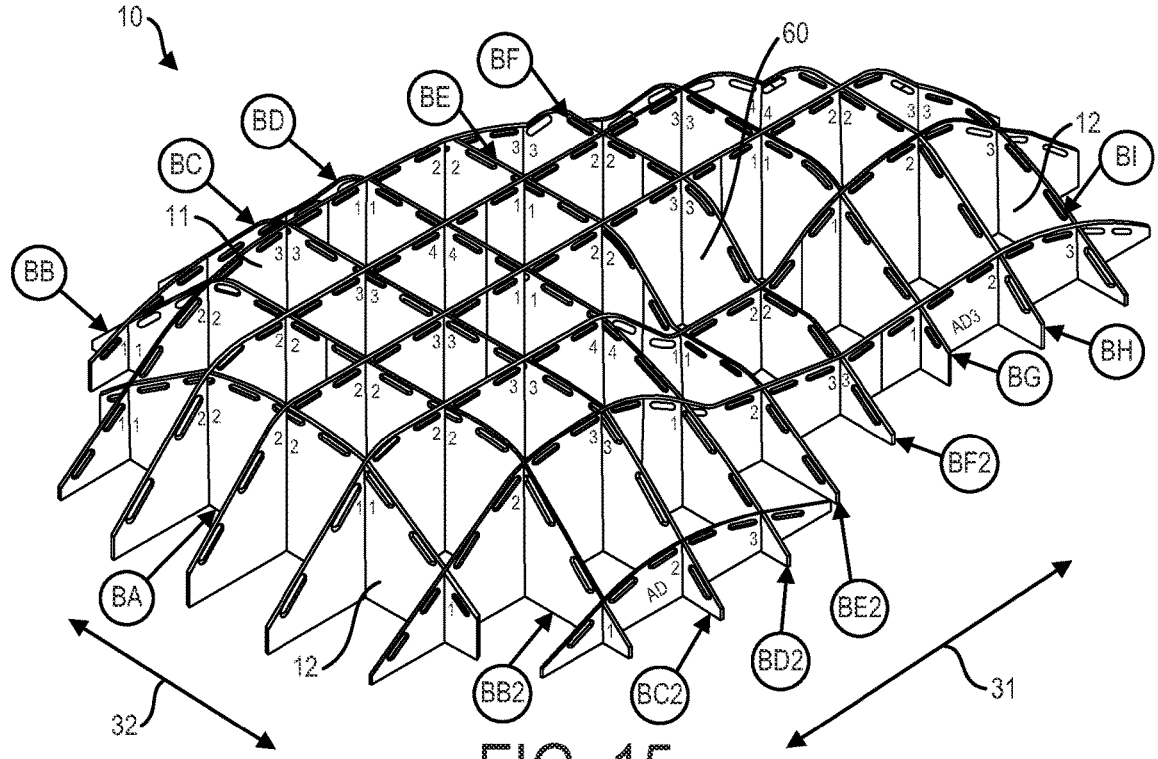
FIG. 15 is a perspective view of the embodiment illustrated in FIG. 14, showing the placement of the "B" panels.
Figure 16:
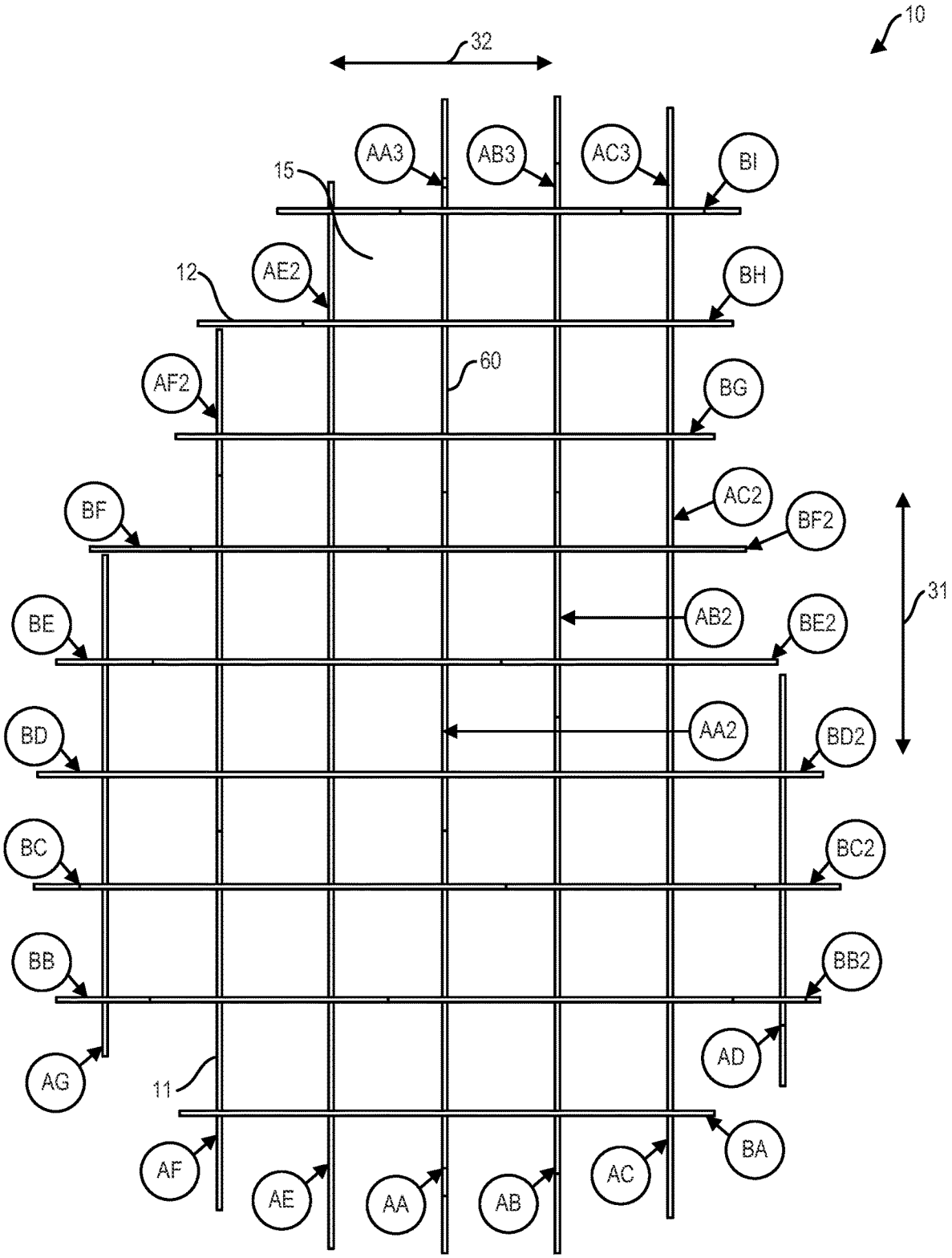
FIG. 16 is a top plan view of the embodiment illustrated in FIG. 14.

Similarly, the independent elements 65 that, together, make up a composite "B" panel 60 are shown in FIG. 12. For instance, the composite panel 60 identified as BB is shown as having two distinct elements 65, a first element identified as BB and a second element identified as BB2. Each of the distinct elements 65 has an edge 61 that is configured to match or substantially match the edge of an adjacent element 65. In this illustration, note that the edges 61 of the elements 65 (e.g. BB and BB2) that would be placed adjacent each other to form the composite panel 60 are shown facing toward one another. Similarly, the composite panels 60 identified as BC and BD are each made up of two distinct elements 65 (BC, BC2 and BD, BD2 respectively).

Figure 8:
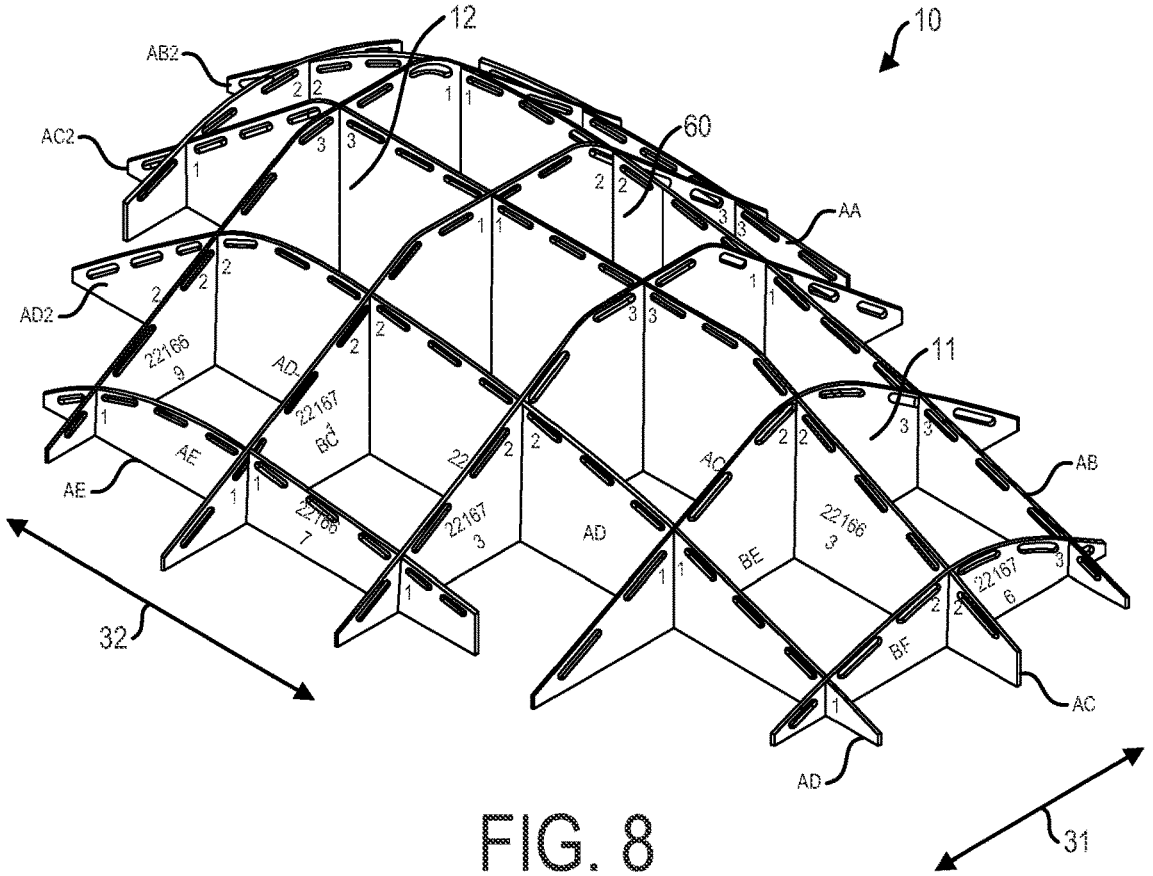
FIG. 8 is a perspective view of a second embodiment of a framework structure for an artificial mound, showing the placement of the "A" panels.
Figure 9:
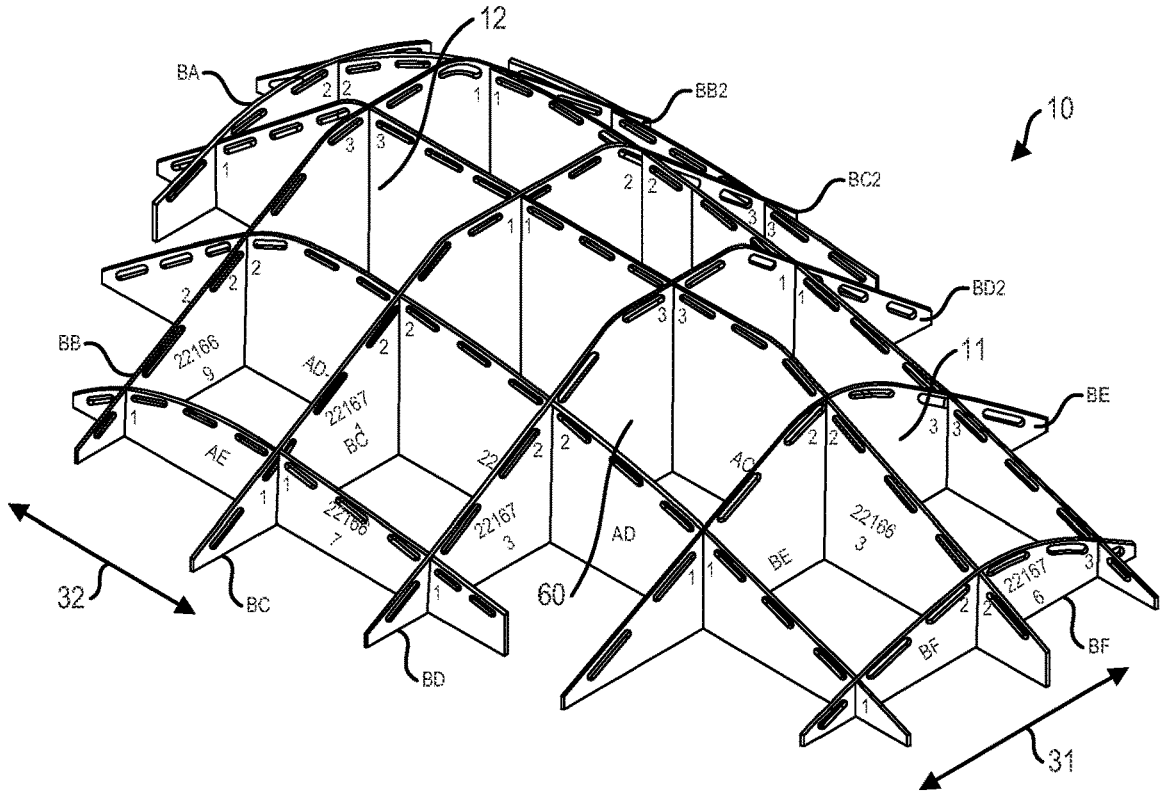
FIG. 9 is a perspective view of the embodiment illustrated in FIG. 8, showing the placement of the "B" panels.
Figure 10:
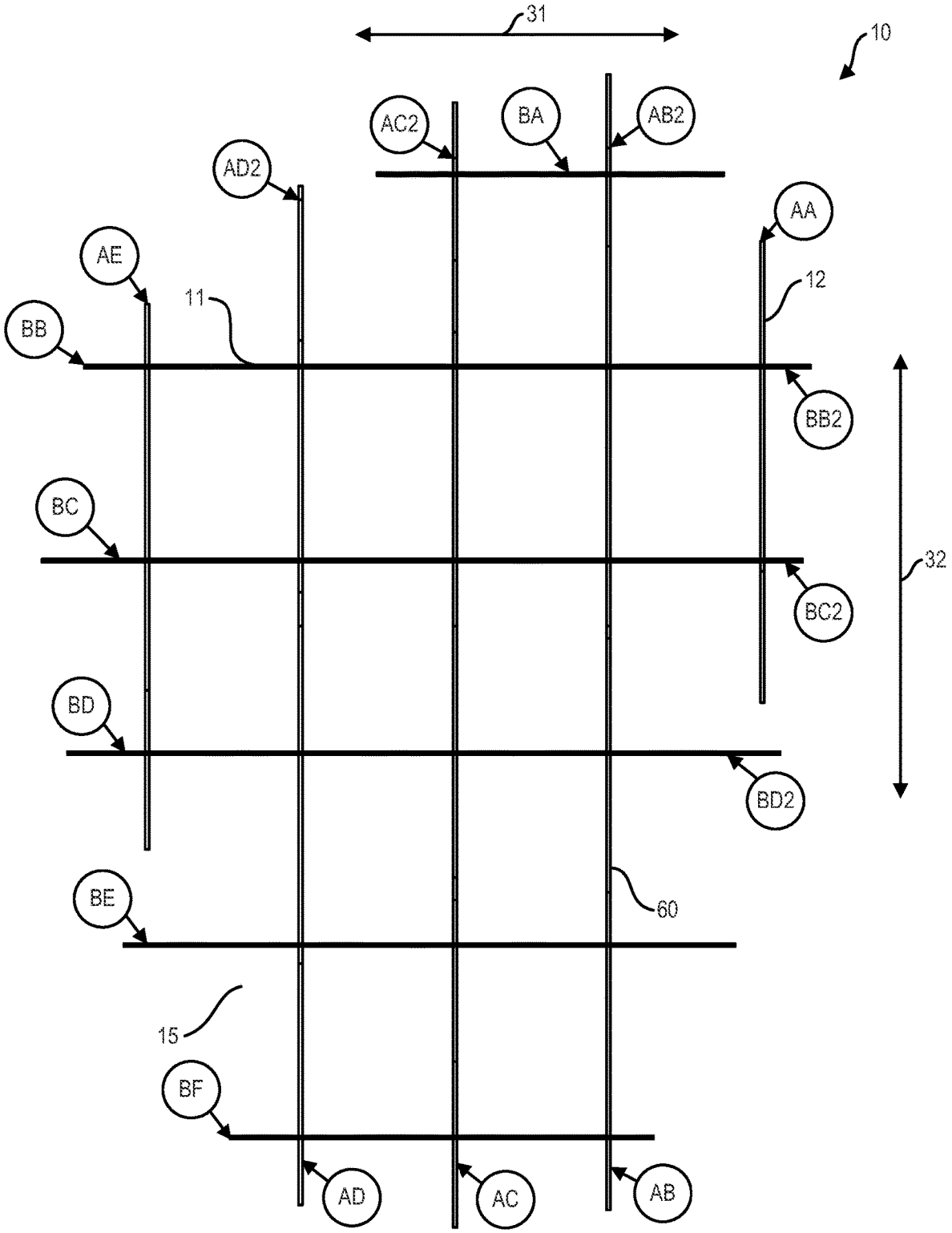
FIG. 10 is a top plan view of the embodiment illustrated in FIG. 8.

As shown in FIGS. 8-10, the edge 61 of each of the independent elements 65 that makes up a composite panel 60 may be placed into contact with the edge 61 of the adjacent element, such that the composite panel 60 does not contain any significant gaps. In some embodiments, the independent elements 65 that make up a composite panel 60 may be secured together, e.g. through any known fasteners including for example tape, clips, etc. It is not, however, necessary that the independent elements 65 be secured to one another. In fact, in some, non-illustrated embodiments, the adjacent edges 61 of the independent elements 65 that make up a composite panel 60 may not contact one another, producing a discontinuous composite panel 60 having one or more gaps.

Composite panels 60 such as those shown in the embodiment illustrated in FIGS. 8-12 allow for the production of structural frameworks 10, and thus artificial topographical structures such as mounds 100, having large dimensions (e.g. lengths and/or widths) from a set 50 of elements 65 having significantly smaller lengths. In the embodiment illustrated in FIGS. 8-12, for example, each of the independent elements 65 that make up a composite panel 60 has a length that is less than eight feet. This facilitates manufacturing, storage, and transportation.

For example, each of the panels 20, including each of the independent elements 65 that make up a composite panel 60, may be cut from a sheet of material having a length of eight feet. And the entire set 50 of panels 20 may be stacked and transported, e.g. as a flat pack assembly, without the assembly being of such a significant length that storage or transport becomes difficult or overly costly. In some embodiments, each of the panels 20, including any independent elements 65 that make up a composite panel 60, within a set 50 may have lengths of eight feet or less, alternatively seven feet or less, alternatively six feet or less, alternatively five feet or less.

Figure 17:
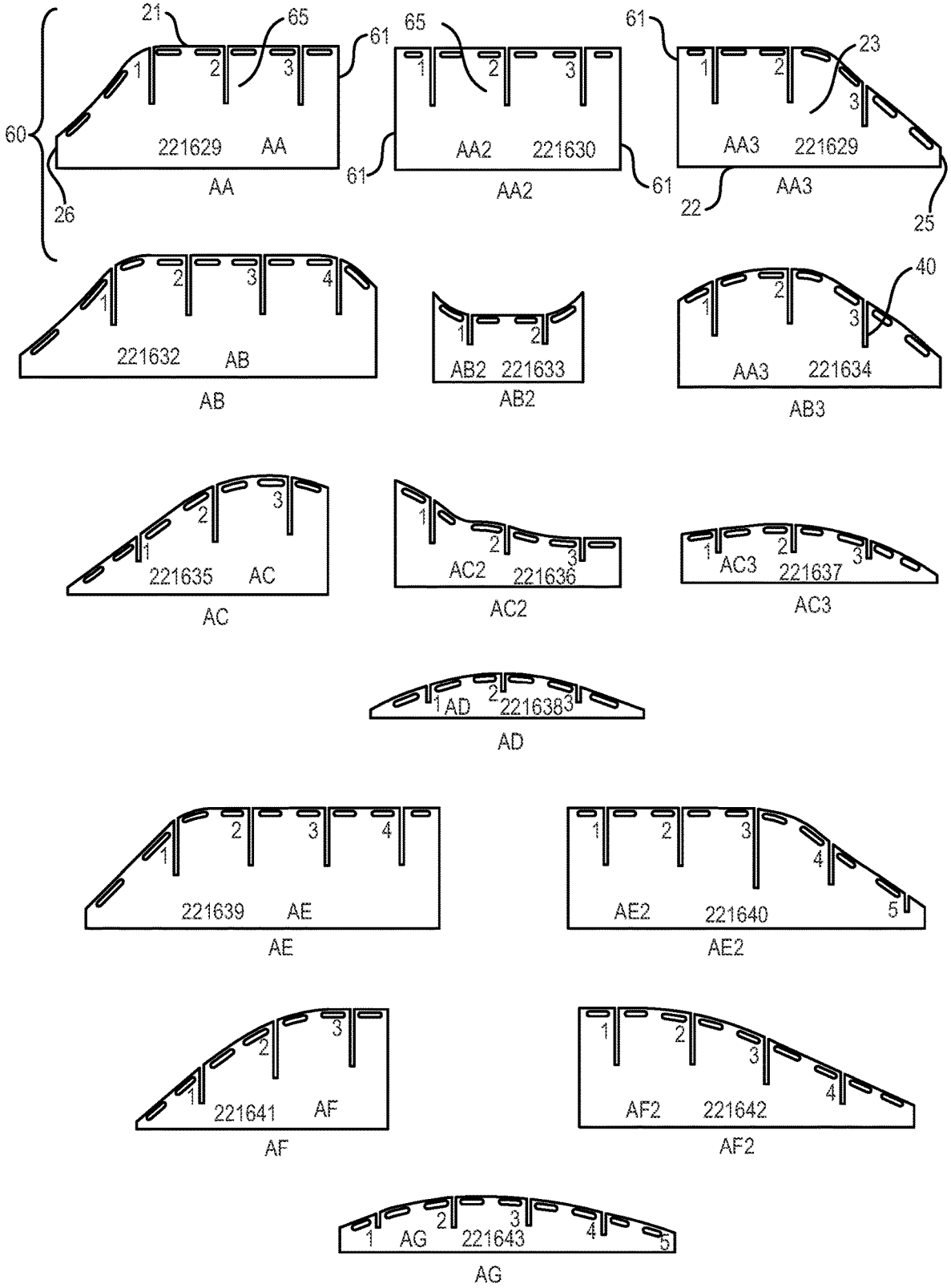
FIG. 17 is an elevation view of the "A" panel structural elements that are assembled to produce the embodiment illustrated in FIG. 14.
Figure 18:
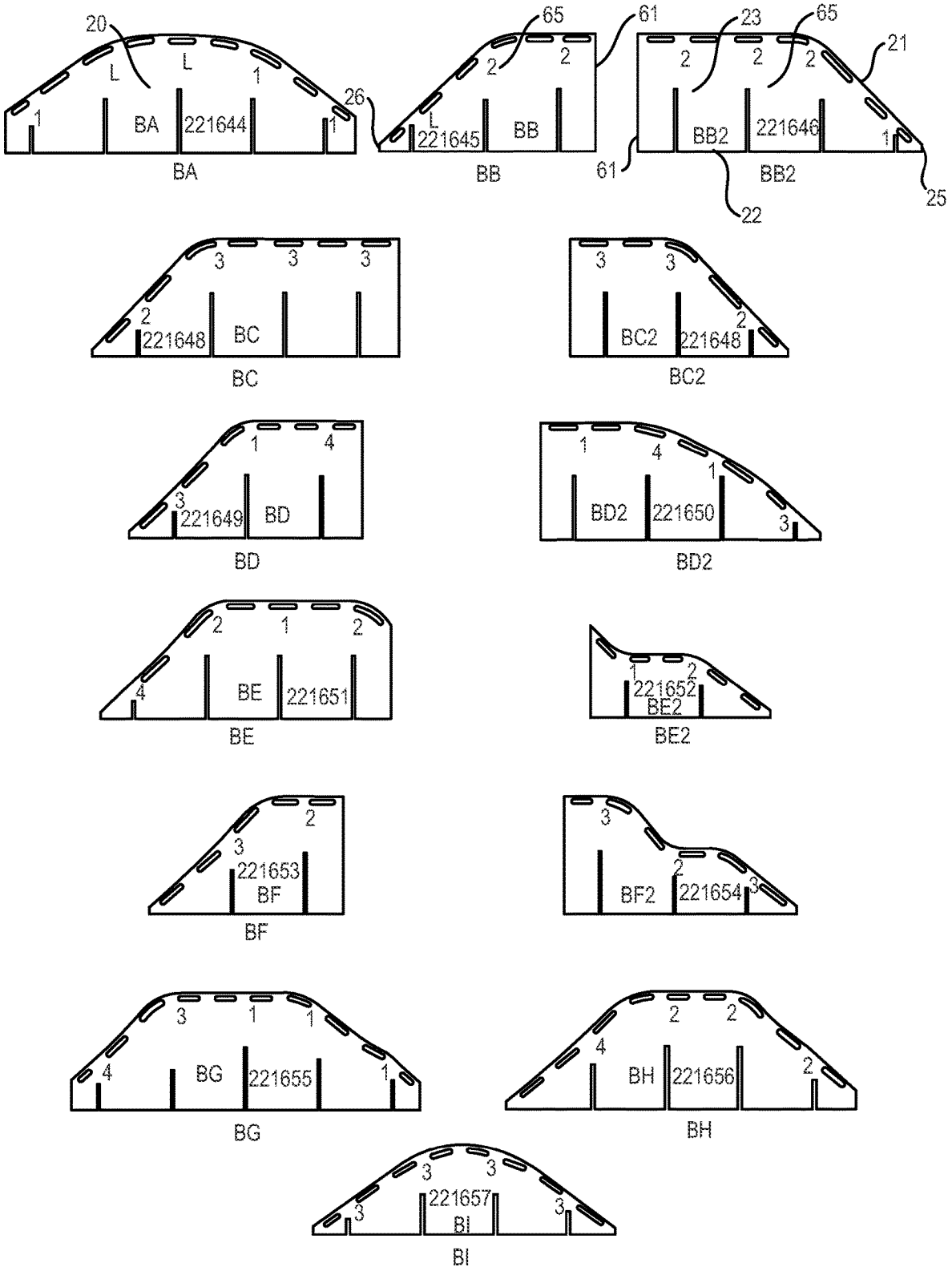
FIG. 18 is an elevation view of the "B" panel structural elements that are assembled to produce the embodiment illustrated in FIG. 14.
Figure 19:
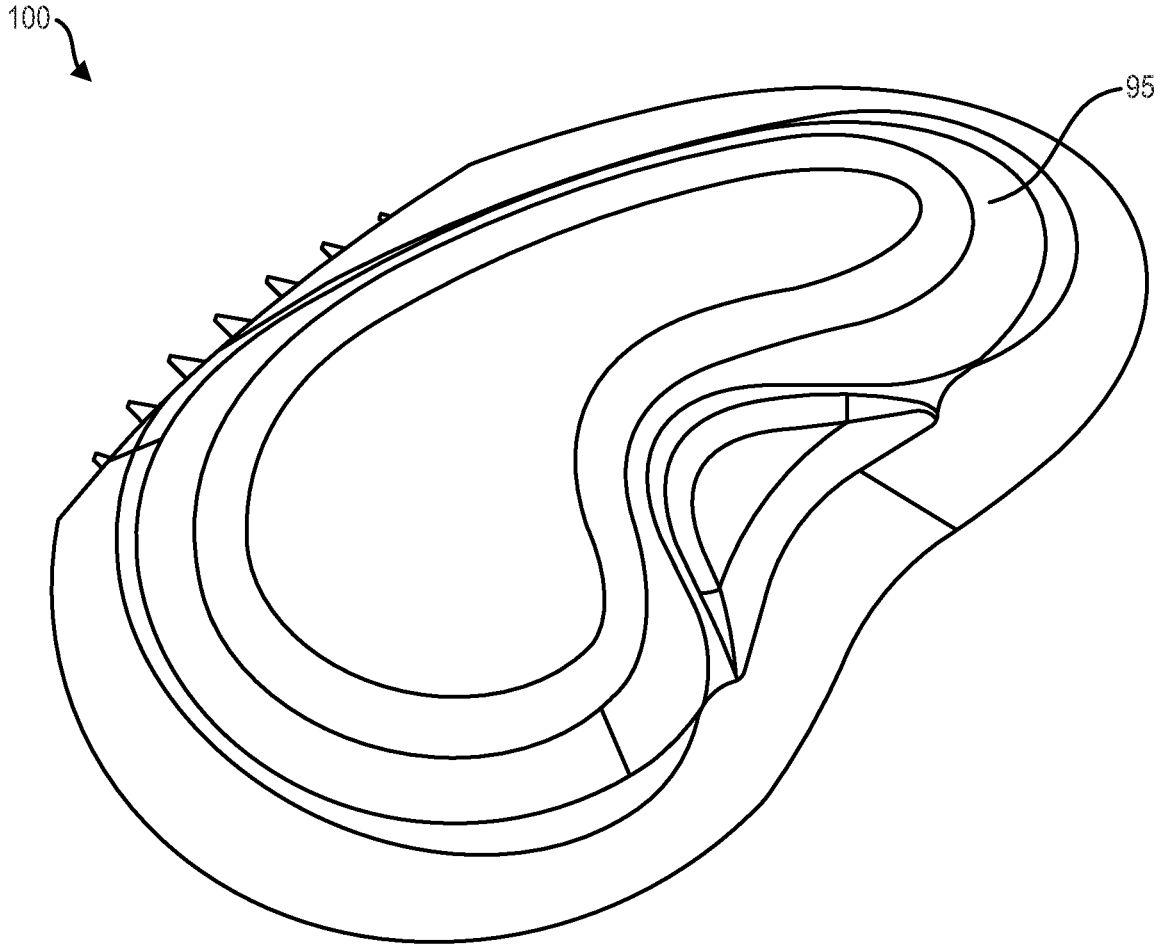
FIG. 19 is a perspective view of an artificial mound produced with the structural framework illustrated in FIG. 14.
Figure 20:
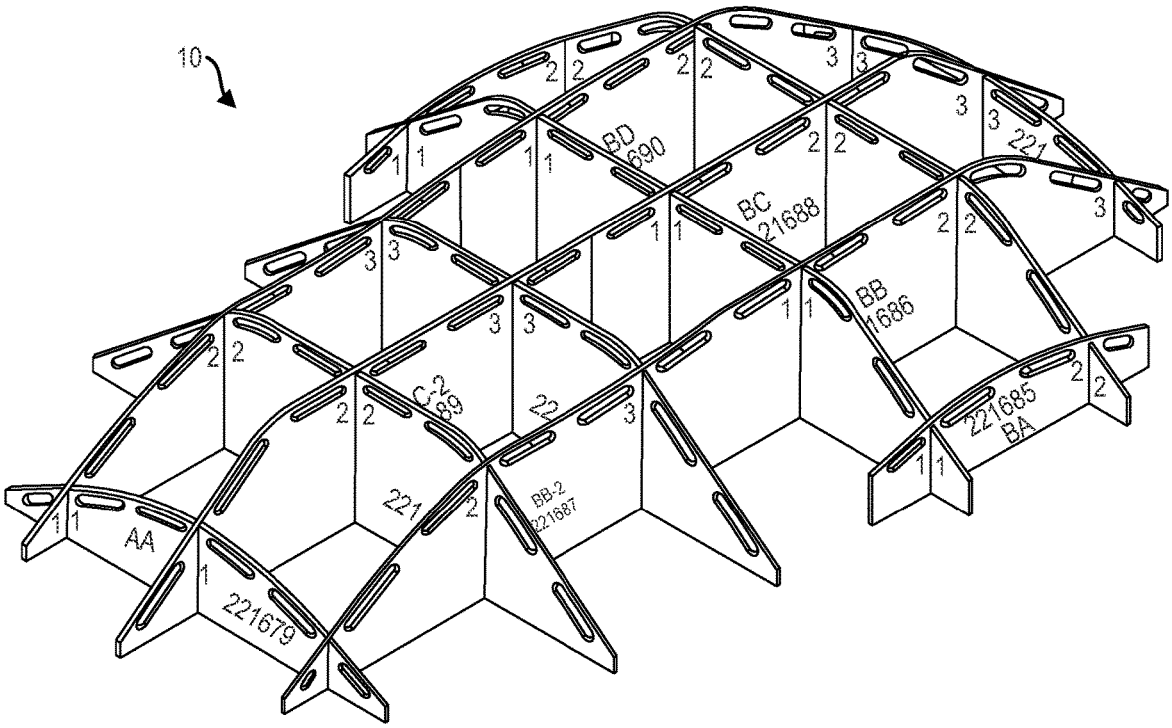
FIG. 20 is a perspective view of a fourth embodiment of a framework structure for an artificial mound.
Figure 21:
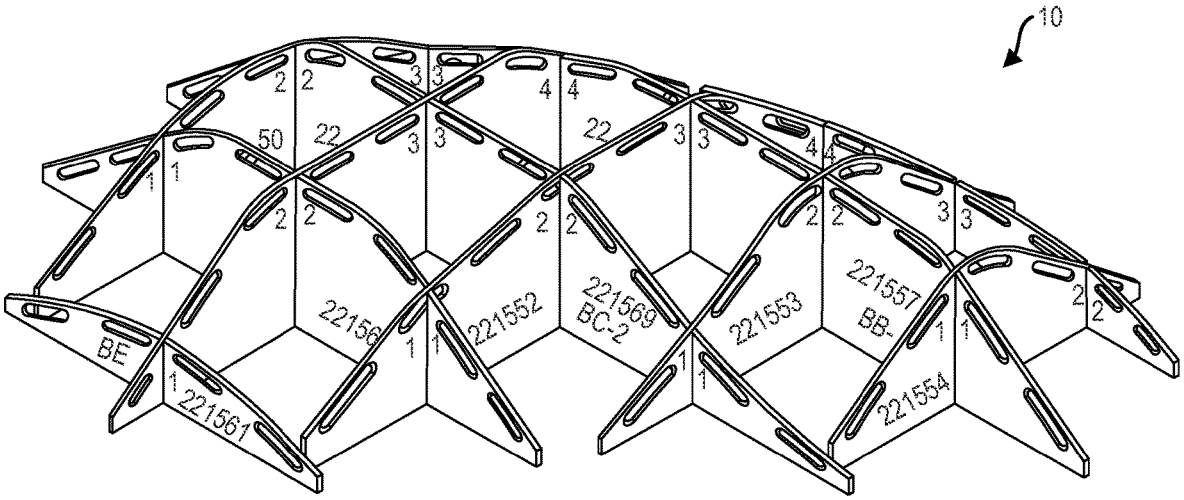
FIG. 21 is a perspective view of a fifth embodiment of a framework structure for an artificial mound.

Though the embodiment illustrated in FIGS. 8-12 includes composite panels 60 that consist of only two independent elements 65, larger framework structures 10 may be assembled using composite panels that are made up of any number of independent elements. In the embodiment illustrated in FIGS. 14-18, for example, a number of composite panels 60 are prepared from three independent elements 65. Specifically, the panel identified as AA is shown in FIG. 17 to consist of three independent elements, identified as AA, AA2, and AA3. Similarly, the panels identified as AB and AC are each made up of three independent elements (Aft AB1, AB2 and AC, AC1, AC2, respectively).

As illustrated in FIG. 17, when a composite panel 60 is made up of three or more independent elements 65, at least one of the independent elements 65 may comprise two edges 61, each of which has a height that is configured to match or substantially match an edge 61 of another element 65 with which it is to be placed in adjacent alignment with to produce a composite panel 60. As the number of elements 65 that make up a composite panel 60 increases beyond three, the number of the elements having two such edges 61 will increase as well.

Once the framework structure 10 has been assembled, e.g. as shown in FIG. 5, its location may be finalized. Embodiments of the framework structure 10 described herein, including the illustrated embodiments, are configured and have sufficient structural integrity to be moved in order to ensure that the framework, and hence the topographical structure, e.g. mound 100, is properly located within the playground. As assembly of the framework structure 10 will generally take place at the playground site, the distances over which the framework structure will need to be moved may generally kept small. Most desirably, the framework structure 10 may be assembled at the intended location of the topographical structure, e.g. mound 100, and the only movement of the framework structure after assembly—if any—will be a final adjustment.

Once the framework structure 10 has been assembled and properly located, a fill material 70 may be added. The framework structure 10 comprises a plurality of spaces 15 defined by two or more panels 20. These spaces 15 may include fully enclosed spaces 16, such as those defined by four panels 20, an adjacent pair of "A" panels 11 and an adjacent pair of "B" panels 12. These spaces 15 may also include partially enclosed spaces, including for instance those defined by one "B" panel 12 and two "A" panels 11 or vice versa (e.g. as identified with reference number 17), those defined by one "A" panel and one "B" panel (e.g. as identified with reference number 18), and those defined by four panels but not fully enclosed (e.g. as identified with reference number 19).

A fill material 70 is deposited in the spaces 15. The fill material 70 may be substantially any material. However, it is important that the fill material 70 does not settle over time, as such settling of the fill material can result in cracking of the support layer and the formation of undesirable soft spots or depressions in the topographical structure, e.g. mound 100.

In some embodiments, the fill material 70 may comprise or consist of crushed stone, such as that referred to as crush-n-run or crusher run. In order to ensure that the fill material 70, e.g. crushed stone, does not settle over time, the fill material may be compacted during filling. Depending on the height of the framework structure 10, the fill material 70 may be compacted only once or numerous times during filling, e.g. in a compacted layering technique. For example, about half of the fill material 70 may be deposited in the spaces 15 and then the fill material within the spaces may be compacted. The remainder of the fill material 70 may then be deposited in the spaces 15 and the fill material within the spaces may again be compacted.

Figure 6:
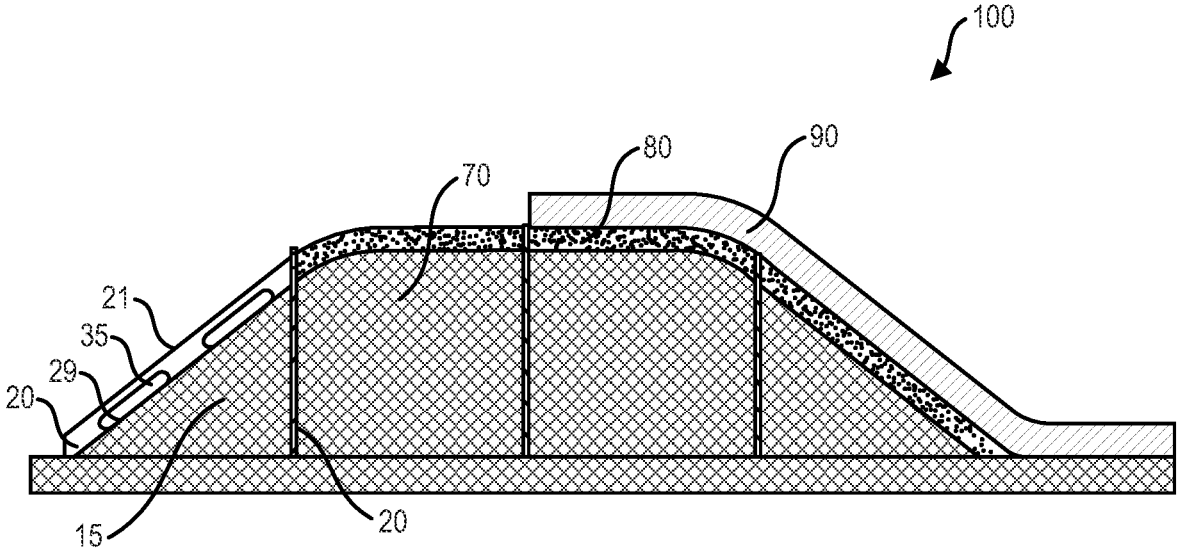
FIG. 6 is a cross-sectional, side elevation view of an embodiment of an artificial mound, showing a relationship between a framework structure, fill material, support layer, and cushion layer.

The fill material 70 is desirably deposited within each of the spaces 70 to a defined height. Desirably, that height is indicated by the structural framework 10, e.g. through the inclusion of one or more level indicators 29 as describe herein. As illustrated in FIG. 6, the fill material 70 is deposited to a height that corresponds or substantially corresponds with the level indicators 29 of the various panels 20 that make up the structural framework 10. In the illustrated embodiment, for instance, the fill material 70 is deposited in the spaces 15 up to a height that corresponds or substantially corresponds with the bottom edge of the apertures 35. In other, non-illustrated embodiments, the fill material 70 may be deposited to a height that corresponds or substantially corresponds with the upper edges 21 of the panels.

Once the fill material 70 has been deposited within the spaces 15 defined by the structural framework 10, a support layer 80 may be applied over top of the fill material and optionally the panels 20. The support layer 80 may be any of a variety of materials, including for examples concrete, asphalt, or the like. In some embodiments, the support layer 80 may comprise or consist of concrete. In the illustrated embodiment, for instance, the support layer 80 is made of concrete having a minimum rating of 3,000 psi and to which reinforced fiber has been added.

The support layer 80 may have a defined or substantially defined thickness. In some embodiments, the support layer 80 may be provided to have (taking into account some unavoidable variation) a substantially consistent defined thickness, for example a thickness of about two inches. In order to ensure that the support layer 80 is applied to the defined thickness, that thickness may be indicated by the structural framework 10. In the illustrated embodiment, for example, the defined distance between the level indicator 29 (here, the bottom edge of apertures 35) and the upper edge 21 of each of the panels 20 represents the defined thickness of the support layer. Accordingly, during installation, the material that makes up the support layer 80—for example concrete—is applied over top of the fill material 70 until it reaches (or just covers) the upper edges 21 of the panels 20 that make up the structural framework 10. The concrete will also flow through apertures 35, thereby joining the various spaces 15 defined by the structural framework 10.

In other embodiments, the support layer 80 may be provided to at least a defined minimum thickness, for example a thickness of at least two inches. In order to ensure that the support layer 80 is applied to at least the minimum thickness, the minimum thickness may be indicated by the structural framework 10. In some embodiments, for example, the defined distance between the level indicator 29 (here, the bottom edge of apertures 35) and the upper edge 21 of each of the panels 20 may represent the minimum thickness of the support layer 80. In other embodiments, the height of fill layer 70 may correspond with the upper edges 21 of the panels and the support layer 80 may simply be applied to a desired thickness over the top of both the fill layer and the structural framework 10.

Once the material that makes up the support layer 80, e.g. concrete, has been applied, the exterior surface that layer of may be smoothed to provide a support layer having a consistent top surface. Further, before the material, e.g. concrete, has completely dried, the top surface of the support layer 80 may be provided with small indentations or grooves (e.g. as may be made with a rake) to assist adhesion of the cushion layer.

Once the support layer 80 has been applied (and the material has dried), a cushion layer 90 is applied. The cushion layer 90 may be made of a variety of materials, so long as it provides the topographical structure, e.g. mound 100, with sufficient shock absorbing properties. In some embodiments, the cushion layer 90 may be made of poured-in-place rubber, such as that conventionally used to provide playground surfaces having shock absorbing properties. For instance, in some embodiments, the cushion layer 90 may be made of the same poured-in-place rubber that is used to provide the rest of a playground surface with shock absorbing properties and/or may be applied at the same time that a cushion layer for the surrounding playground surface is applied. Application of the poured-in-place rubber may be performed by known techniques. Desirably, the cushion layer 90 is applied such that the transition from the topographical structure, e.g. mound 100, to the surrounding playground surface is continuous and smooth, e.g. as illustrated in FIG. 6.

The thickness of the cushion layer 90 will depend both on the particular properties of the material and the fall height requirements, which will vary depending on the height of the surrounding and/or incorporated playground components.

In some embodiments, the topographical structure, e.g. mound 100, may also be provided with a finish layer 95. The finish layer 95 may be selected from a variety of materials to provide the topographical structure, e.g. mound 100, with a desired exterior surface. In some embodiments, for instance, the finish layer 95 may be a cap layer of poured-in-place rubber, e.g. one that may provide the surface of the mound 100 with one or more desired colors and/or patterns; synthetic grass; turf; or the like. When a cap layer of poured-in-place rubber is used, the cap layer may comprise EPDM, TPV (thermoplastic vulcanizates), or a treated rubber/polyurethane blend. The finish layer 95 may also be applied to the surrounding playground surface or the finish layer of the mound may be different from the surface layer of the surrounding playground.

Figure 29:
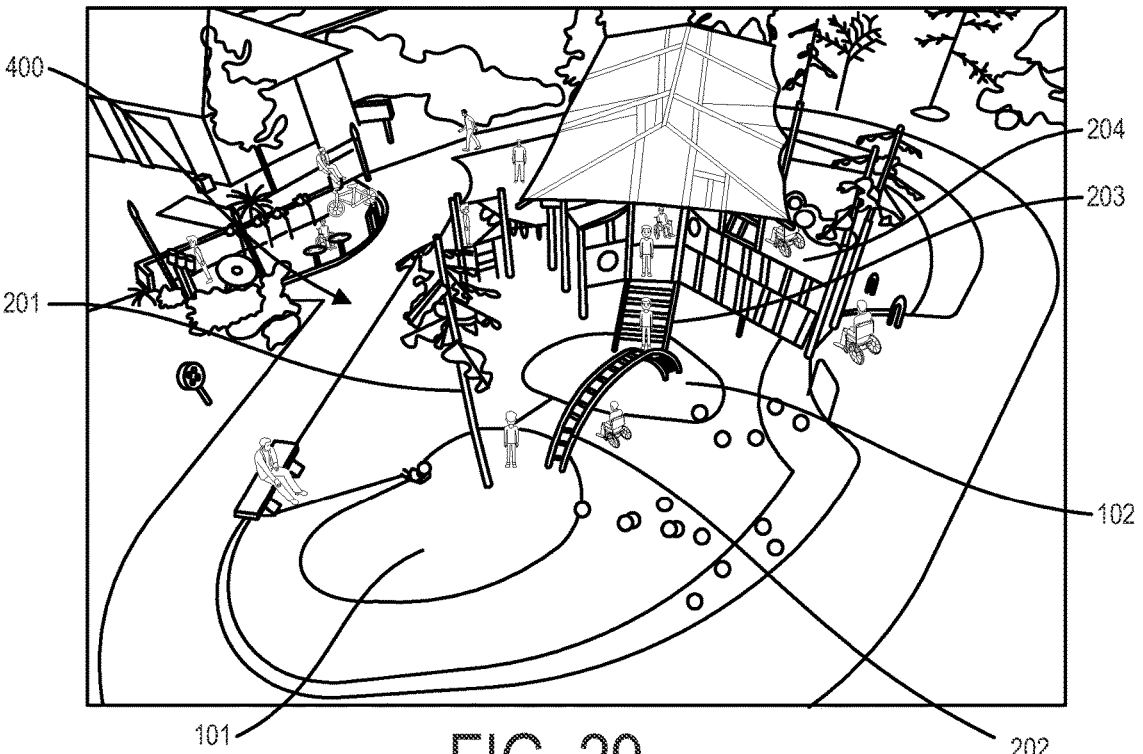
FIG. 29 is a perspective view of a playground having a topography that comprises multiple embodiments of artificial mounds, in particular those produced from the structural frameworks illustrated in FIG. 28.

In some embodiments, the finish layer 95 may be used to draw a distinction between the artificial mound 100 and the surrounding playground surface, e.g. through the use of different colors or the like. For example, the artificial mounds 100 in the playground 400 illustrated in FIG. 29 have a finish layer 95 comprising one or more shades of green, whereas the cap layer of at least a portion of the surrounding playground surface is a shade of blue. The resulting visual effect is one of the artificial mounds 100 rising, e.g. as islands, out of a sea of blue. This is just one example of how the artificial topographical structures, e.g. mounds 100, of the present disclosure may be incorporated into a playground to significantly enhance the value of the playground.

The topographical structures, e.g. mounds 100, of the present disclosure may also be directly integrated with one or more playground components 200. In the playground 400 illustrated in FIG. 29 for example, each of the artificial mounds 100 has at least one playground component 200 integrated therein. Specifically artificial mound 101 has both a vertical climber 201 and a first end of an overhead ladder 202 integrated therein. Artificial mound 102 has both a second end of the overhead ladder 202 and a first end of a rope climber 203 integrated therein. The second end of rope climber 203 is attached to an elevated play structure 204. In this manner, the artificial mounds 101, 102 are heavily integrated into the playground design, such that they form an integral part of the playground.

The topographical structures, e.g. mounds 100, of the present disclosure enable the integration of any of a variety of playground components 200 during the playground design process. The opportunities for creative playground design that are presented through the integration of artificial topographical structures 100 designed in accordance with the present disclosure and other playground components 200 are endless.

Figure 7:
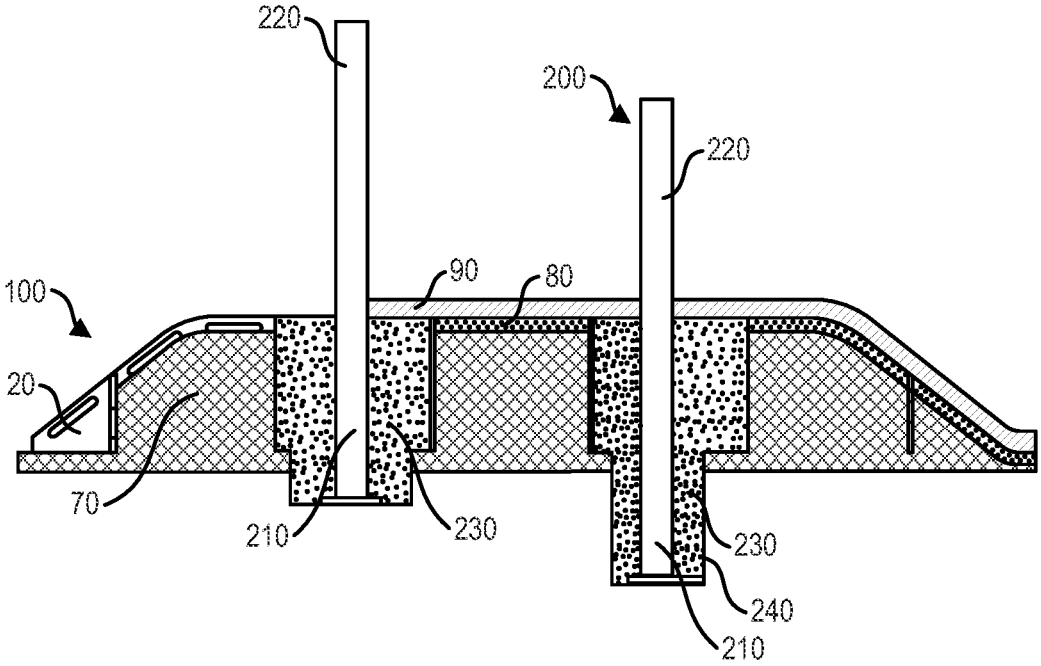
FIG. 7 is a cross-sectional, side elevation view of an embodiment of an artificial mound, having a playground component incorporated therein.

Embodiments of the topographical structures, e.g. mounds 100, of the present disclosure may comprise a playground component 200 having a first portion 210 extending into the structure and a second portion 220 that projects from an exterior surface of the topographical structure, e.g. mound. The first portion 210 may extend into one or more of the spaces 115 formed by the structural framework 10. As illustrated in FIG. 7, the first portion 210 of a playground component, here a post, extends into a space defined by the structural framework 10.

In order to provide the playground component 200 with sufficient stability, the space 15 into which the first portion 210 extends may be filled with a hardening material 230 such as concrete, asphalt, or the like. In the illustrated embodiment, for example, the space 15 surrounding the first portion 210 is filled with concrete. The hardening material 230 may be filled to the same height to which the support layer 80 is provided, such that the top of hardening material 230 that stabilizes the playground component 200 and the support layer 80 may form a substantially continuous surface over which the cushion layer 90 may be applied.

In some embodiments, one or more ground holes 240 may be dug to a desired depth, the first portion 210 of the playground component may be inserted through one or more spaces 15 defined by the framework structure 10 and into the one or more ground holes, and the one or more ground holes may be filled with hardening material 230 such as concrete. The depth of the one or more ground holes 240 will depend on the type of playground component 200, the height of the playground component, etc. An example of such an arrangement is shown in FIG. 7. In some, non-illustrated embodiments, the ground hole 240 may be dug to a sufficient depth and filled with hardening material 230, such that the space 15 defined by the framework structure 10 through which the first portion 210 of the playground component extends may instead be filled with fill material 70 and covered with support layer 80 in the same manner as the other spaces defined by the framework structure.

As illustrated in FIG. 7, the cushion layer 90, and the optional finish layer 95, may span up to and into contact with the first portion 210 of the playground component, such that the second portion 220 of the playground component projects from the surface of the topographical structure, e.g. mound 100.

Figure 30:
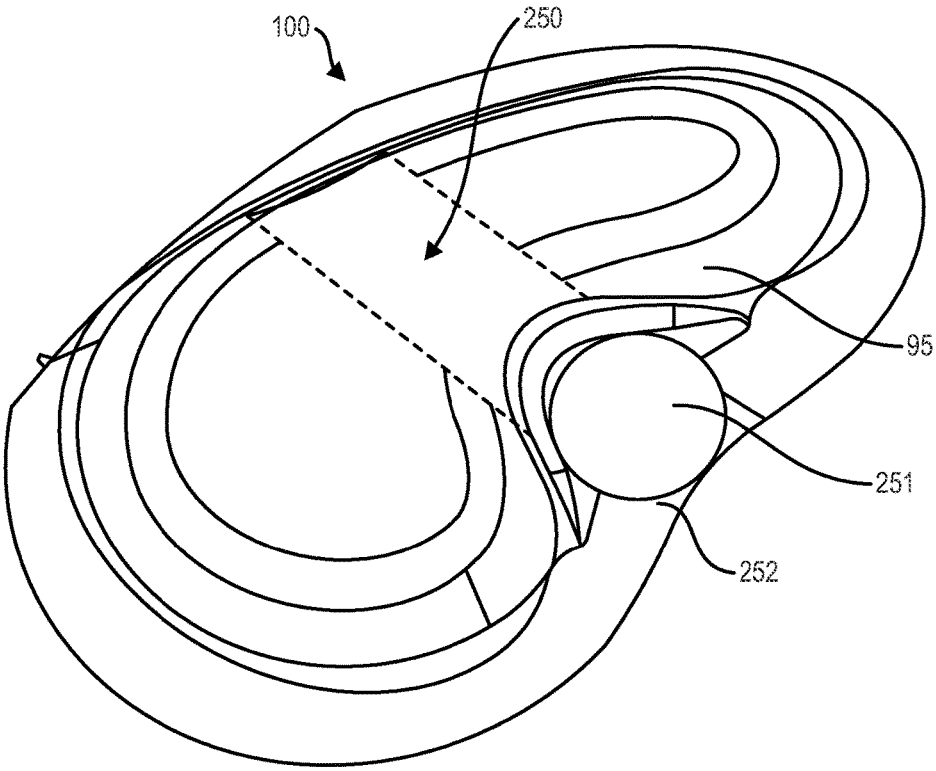
FIG. 30 is a perspective view of an embodiment of an artificial mound having a tunnel incorporated therein.

Embodiments of the topographical structures, e.g. mounds 100, of the present disclosure may also be configured to accommodate one or more tunnels 250 extending through the structure. An example of such an embodiment is shown in FIG. 30. For example, one or more of the panels 20 that make up the structural framework 10 may comprise an aperture configured to receive a portion of a component, e.g. tube 251, though which a child may crawl. In some embodiments, for instance, a plurality of adjacent panels 20 may comprise apertures configured to receive a portion of a tube 251 and a tube may extend through the apertures. The one or more components that make up the tube 251 may be inserted during or immediately after assembly of the structural framework 10 and prior to filling the spaces 15 of the framework with fill material 70.

The ends 252 of the tube 251 are positioned such that application of the support layer 80, cushion layer 90, and optional finish layer 95 do not cover the openings. For instance, an end 252 of the tube 251 may be configured (e.g. designed to have an angle of incline that matches the surrounding portion of a topographical structure) and positioned so that the top layer, e.g. finish layer 95, of the topographical structure, e.g. mound 100, runs up to, but not over, the end of the tube, such that the sidewall of the tube is substantially fully enclosed by the mound 100.

As described herein, artificial topographical structures having an of a variety of contoured surfaces may be produced by designing a structural framework 10 having the appropriate layout of upper edges 21 to produce the desired contour and producing a set 50 of panels 20 that can be assembled together to prepare that structure. The topographical structures range from the relatively simple, see for instance the embodiment shown in FIGS. 22-24 to the complex, see for instance the embodiment illustrated in FIGS. 14-19 or the embodiment illustrated in FIGS. 25-27.

Once a design for a structural framework 10 has been created and the set 50 of panels 20 produced, it may be easy to reproduce that structural framework as many times as desired, such that one may simply select pre-designed topographical structures from a catalog and/or website. Similarly, a variety of pre-designed topographical structures may be included in a playground design software, such that a user may select and insert one or more topographical structures into a playground design in the same manner that the user would select and insert other playground components.

Alternatively, one or more customized topographical structures, and hence customized structural frameworks 10, may be designed for a particular playground and one or more sets 50 of panels 20 produced and used to prepare the customized structural frameworks.

The footprint and/or height of a topographical structure can be carefully controlled during design of the structural framework 10. In some embodiments, for instance, a topographical structure may have a structural framework 10, in which the first plurality of structural elements 11 comprises at least three panels 20 (or composite panels 60), alternatively at least four panels, alternatively at least five panels, alternatively at least six panels; and/or the second plurality of structural elements 12 comprises at least three panels (or composite panels), alternatively at least four panels, alternatively at least five panels, alternatively at least six panels.

The contour of a topographical structure can also be carefully controlled during design of the structural framework 10 by varying the design of the upper edges 21 of the panels 20. For many artificial mounds 100, one or more of the panels 20 may have a common general design. In some embodiments, for example, the upper edge 21 of at least of the panels 20 (or composite panels 60) may comprises a straight or substantially straight central portion extending along the longitudinal axis and first and second end portions, each of which is angled or curved from the central portion toward the lower edge 22 of the panel. As another example, in some embodiments, the upper edge 21 of at least of the panels 20 (or composite panels 60) may comprise a rounded central portion and first and second end portions, each of which is angled or curved from the central portion toward the lower edge of the panel 22. As another example, in some embodiments, the upper edge 21 of at least of the panels 20 (or composite panels 60) may comprise a first straight portion at a first height and a second straight portion at a second height, the second height differing from the first height. As another example, in some embodiments, the upper edge 21 of at least of the panels 20 (or composite panels 60) may comprise a first portion and a second portion separated by a third, concave portion, optionally in which the first and second portions are straight or substantially straight and extend along the longitudinal axis. As another example, in some embodiments, the upper edge 21 of at least of the panels 20 (or composite panels 60) may comprise a first portion and a second portion separated by a third, convex portion, optionally in which the first and second portions are straight or substantially straight and extend along the longitudinal axis.

Figure 31:
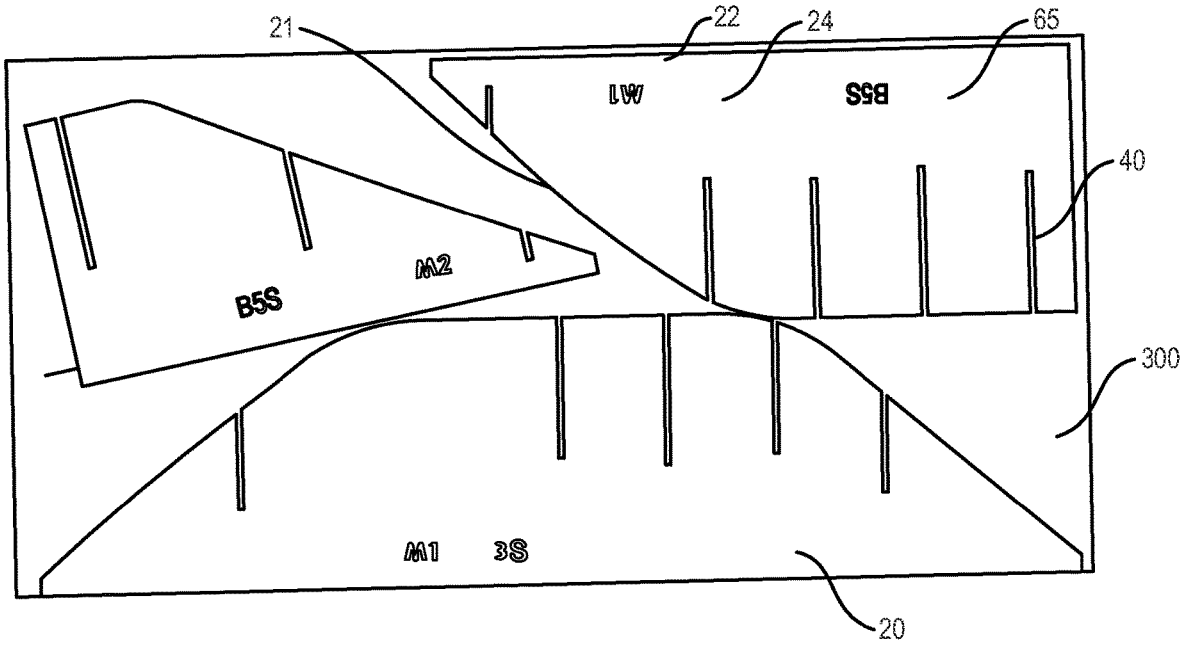
FIG. 31 is an elevation view of an embodiment of a pre-cut sheet of framework structural elements.

Moreover, manufacture, transportation, and/or installation of the panels may also be more cost-effective than conventional mounds. For example, the panels 20 can be designed using computer software and/or cut from a sheet of material 300 using a computer-controlled cutting tool. In order to make the most efficient usage of the sheet material 300, i.e. minimize waste material, computer software can also be used to identify the location and orientation for each of a set 50 of panels 20 prior to cutting, an example of which is shown in FIG. 31. Assembly of the framework structure 10 can be performed quickly and without the need for specialized labor. For instance, apart from the most complex designs, many framework structures 10 may be assembled in less than an hour, typically much less (e.g. less than a half-hour). Embodiments of the present disclosure may also include any of a number of features, e.g. panel identifiers, level indicators, etc., that help ensure proper mound installation.

It can be seen that the described embodiments provide unique and novel playground topographical structures and sets of components that can be assembled to produce a framework for such topographical structures that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

Example Embodiments

Artificial Mounds

1. An artificial mound for a playground, comprising:
   - a structural framework comprising
     - a first plurality of structural elements having longitudinal axes extending in a first direction, and
     - a second plurality of structural elements having longitudinal axes extending in a second direction,
     - wherein the second direction is transverse to the first direction, and
     - each of the second plurality of structural elements is connected to one or more of the first plurality of structural elements; and
   - wherein each structural element comprises an upper edge, the upper edges together being configured to provide the artificial mound with a contoured surface.

2. The artificial mound of any preceding embodiment, wherein the second direction is perpendicular or substantially perpendicular to the first direction, such that the longitudinal axes of the second plurality of structural elements form right angles with the longitudinal axes of the first plurality of structural elements.

3. The artificial mound of any preceding embodiment, wherein at least one of the second plurality of structural elements comprises one or more slots, each of the one or more slots receiving a portion of one of the first plurality of structural elements; optionally wherein each of the second plurality of structural elements comprises one or more slots, each of the one or more slots receiving a portion of one of the first plurality of structural elements.

4. The artificial mound of any preceding embodiment, wherein at least one of the first plurality of structural elements comprises one or more slots, each of the one or more slots receiving a portion of one of the second plurality of structural elements; optionally wherein each of the second plurality of structural elements comprises one or more slots, each of the one or more slots receiving a portion of one of the first plurality of structural elements.

5. The artificial mound of any preceding embodiment, wherein each of the one or more slots of the first plurality of structural elements extend upward from a lower edge of the first structural element and each of the one or more slots of the second plurality of structural elements extend downward from the upper edge of the second structural element.

6. The artificial mound of any preceding embodiment, wherein

Each of the one or more slots of the second plurality of structural elements receives a portion of one of the first plurality of structural elements positioned directly above one of the one or more slots of the first structural element; and Each of the one or more slots of the first plurality of structural elements receives a portion of one of the second plurality of structural elements positioned directly below one of the one or more slots of the second structural element.

7. The artificial mound of any preceding embodiment, wherein each of the structural elements has flat or substantially flat side surfaces.

8. The artificial mound of any preceding embodiment, wherein each structural element has a thickness less than 4 inches, alternatively less than 3 inches, alternatively less than 2 inches.

9. The artificial mound of any preceding embodiment, wherein each of the structural elements has a straight lower edge extending along the longitudinal axis.

10. The artificial mound of any preceding embodiment, wherein at least one of the structural elements is made of plastic, optionally wherein the plastic is high density polyethylene.

11. The artificial mound of any preceding embodiment, wherein each of the structural elements comprises one or more level indicators a defined distance from an upper edge of the structural element.

12. The artificial mound of any preceding embodiment, wherein the one or more level indicators comprise one or more apertures.

13. The artificial mound of any preceding embodiment, in which at least one of the first plurality of structural elements is configured to be positioned with its longitudinal axis in alignment with at least one other of the first plurality of structural elements in order to produce a composite panel; at least one of the second plurality of structural elements is configured to be positioned with its longitudinal axis in alignment with at least one other of the second plurality of structural elements in order to produce a composite panel; or both.

14. The artificial mound of any preceding embodiment, wherein at least one of the structural elements comprises a curved upper edge.

15. The artificial mound of any preceding embodiment, wherein at least one of the structural elements or composite panels comprises an upper edge having a straight central portion extending along the longitudinal axis and first and second end portions that are angled or curved from the central portion toward a lower edge.

16. The artificial mound of any preceding embodiment, wherein at least one of the structural elements or composite panels comprises an upper edge having a first straight portion at a first height and a second straight portion at a second height, the second height differing from the first height.

17. The artificial mound of any preceding embodiment, wherein at least one of the structural elements or composite panels comprises an upper edge having a first portion and a second portion separated by a third, concave portion; optionally in which the first and second portions are straight and extend along the longitudinal axis.

18. The artificial mound of any preceding embodiment, wherein at least one of the structural elements or composite panels comprises an upper edge having a first portion and a second portion separated by a third, convex portion; optionally in which the first and second portions are straight and extend along the longitudinal axis.

19. The artificial mound of any preceding embodiment, further comprising a fill material in a plurality of spaces formed by the structural framework.

20. The artificial mound of any preceding embodiment, wherein the fill material comprises or consists of crushed stone.

21. The artificial mound of any preceding embodiment, wherein the fill material is present in the plurality of spaces formed by the structural framework to the height identified by the level indicator.

22. The artificial mound of any preceding embodiment, further comprising one or more layers that cover the structural framework, the fill material, or both.

23. The artificial mound of any preceding embodiment, wherein the one or more layers comprise at least a support layer and a cushion layer.

24. The artificial mound of any preceding embodiment, wherein the support layer comprises or consists of concrete.

25. The artificial mound of any preceding embodiment, wherein the thickness of the support layer is substantially equivalent to the distance between the level indicator and the upper edge of the structural element.

26. The artificial mound of any preceding embodiment, wherein the cushion layer comprises or consists of poured-in-place rubber.

27. The artificial mound of any preceding embodiment, wherein the one or more layers further comprises a finish layer.

28. The artificial mound of any preceding embodiment, wherein the finish layer comprises or consists of poured-in-place rubber (e.g. a cap layer), synthetic grass, or turf.

29. The artificial mound of any preceding embodiment, further comprising a playground component extending into the artificial mound.

30. The artificial mound of any preceding embodiment, in which a portion of the playground component extends between adjacent structural elements.

31. The artificial mound of any preceding embodiment, further comprising at least a surface layer that covers the structural framework, and wherein the surface layer contacts the playground component, such that the playground component projects from the surface layer.

32. The artificial mound of any preceding embodiment, wherein a space between adjacent structural elements into which the portion of the playground component extends is filled with concrete.

33. The artificial mound of any preceding embodiment, further comprising a tunnel extending through the mound.

34. The artificial mound of any preceding embodiment, in which each of a plurality of adjacent structural elements comprises an aperture and one or more tube elements extend through the apertures to produce the tunnel.

35. The artificial mound of any preceding embodiment, further comprising an access element configured for a user of a mobility device, e.g. a wheelchair, to access the top surface of the mound.

36. The artificial mound of any preceding embodiment, in which the first plurality of structural elements comprises at least three structural elements, alternatively at least four structural elements, alternatively at least five structural elements, alternatively at least six structural elements; and the second plurality of structural elements comprises at least three structural elements, alternatively at least four structural elements, alternatively at least five structural elements, alternatively at least six structural elements.

37. The artificial mound of any preceding embodiment, wherein at least one, and optionally each, of the structural elements has a front edge and a rear edge, each of which extends vertically a desired length.

38. The artificial mound of any preceding embodiment, in which the surface contour of the artificial mound is customized.

39. A playground comprising an artificial mound of any preceding embodiment.

Framework Sets

B1. A set for forming a structural framework for an artificial mound, the set comprising:

a plurality of structural elements, each of which comprises first and second side surfaces, an upper edge, a lower edge, and a longitudinal axis;

wherein each of the plurality of structural elements is configured to connect to one or more other of the plurality of structural elements at one or more predetermined points to form the structural framework; and wherein the upper edges of the plurality of structural elements are shaped to provide the artificial mound with a surface having a predetermined contour.

B2. The set of any preceding embodiment, wherein the plurality of structural elements are configured for a first subset of structural elements to be arranged with their longitudinal axes extending in a first direction and a second subset of structural elements to be arranged with their longitudinal axes extending in a second direction, the second direction being transverse to the first direction.

B3. The set of any preceding embodiment, wherein the second direction is perpendicular to the first direction, e.g. such that the structural framework forms a grid.

B4. The set of any preceding embodiment, wherein at least one of the structural elements comprises one or more slots, each of the one or more slots being positioned at one of the predetermined points of connection with another structural element and configured to receive a portion of the structural element to which it is connected.

B5. The set of any preceding embodiment, wherein each of the structural elements comprises one or more slots, each of the one or more slots being positioned at one of the predetermined points of connection with another structural element and configured to receive a portion of the structural element to which it is connected.

B6. The set of any preceding embodiment, wherein the slots of at least one of the structural elements extend upward from the lower edge and the slots of at least one of the structural elements extend downward from the upper edge.

B7. The set of any preceding embodiment, wherein each of the first subset of structural elements comprises one or more slots, each slot being positioned at one of the predetermined points of connection with one of the second subset of structural elements and configured to receive a portion of the structural element to which it is connected.

B8. The set of any preceding embodiment, wherein each of the second subset of structural elements comprises one or more slots, each slot being positioned at one of the predetermined points of connection with one of the first subset of structural elements and configured to receive a portion of the structural element to which it is connected.

B9. The set of any preceding embodiment, wherein the slots of each of the first subset of structural elements extend upward from the lower edge and the slots of each of the second subset of structural elements extend downward from the upper edge.

B10. The set of any preceding embodiment, wherein the slots of the second subset of structural elements and the slots of the first subset of structural elements are configured such that i. each slot of the second subset of structural elements receives a portion of one of the first subset of structural elements positioned directly above the slot of the structural element of the first subset; and ii. each slot of the first subset of structural elements receives a portion of one of the second subset of structural elements positioned directly below the slot of the structural element of the second subset.

B11. The set of any preceding embodiment, wherein at least one of the structural elements is made of plastic, optionally wherein the plastic is high density polyethylene.

B12. The set of any preceding embodiment, wherein the first and second side surfaces are flat or substantially flat.

B13. The set of any preceding embodiment, in which at least one of the first subset of structural elements is configured to be positioned with its longitudinal axis in alignment with at least one other of the first subset of structural elements in order to produce a composite panel; at least one of the second subset of structural elements is configured to be positioned with its longitudinal axis in alignment with at least one other of the second subset of structural elements in order to produce a composite panel; or both.

B14. The set of any preceding embodiment, in which the set of structural elements are configured to be stacked and shipped as a flat pack assembly.

B15. The set of any preceding embodiment, wherein each structural element has a thickness (between the first and second side surfaces) less than 4 inches, alternatively less than 3 inches, alternatively less than 2 inches.

B16. The set of any preceding embodiment, wherein one or more of the structural elements comprises a level indicator a defined distance from the upper edge.

B17. The set of any preceding embodiment, wherein the level indicator comprises one or more apertures.

B18. The set of any preceding embodiment, wherein the one or more apertures are sized and configured to receive a user's fingers, such that the one or more apertures serve as a handle.

B19. The set of any preceding embodiment, wherein the lower edge of the one or more apertures serves as the level indicator.

B20. The set of any preceding embodiment, wherein the lower edge of each structural element is straight and extends along the longitudinal axis.

B21. The set of any preceding embodiment, wherein at least one of the structural elements comprises a curved upper edge.

B22. The set of any preceding embodiment, wherein at least one of the structural elements or composite panels comprises an upper edge having a straight central portion extending along the longitudinal axis and first and second end portions that are angled or curved from the central portion toward the lower edge.

B23. The set of any preceding embodiment, wherein at least one of the structural elements or composite panels comprises an upper edge having a first straight portion at a first height and a second straight portion at a second height, the second height differing from the first height.

B24. The set of any preceding embodiment, wherein at least one of the structural elements or composite panels comprises an upper edge having a first portion and a second portion separated by a third, concave portion; optionally in which the first and second portions are straight and extend along the longitudinal axis.

B25. The set of any preceding embodiment, wherein at least one of the structural elements or composite panels comprises an upper edge having a first portion and a second portion separated by a third, convex portion; optionally in which the first and second portions are straight and extend along the longitudinal axis.

B26. The set of any preceding embodiment, in which one or more of the plurality of structural elements is labeled to identify a predetermined position within the grid; optionally in which each of the plurality of structural elements is labeled to identify a predetermined position within the grid.

B27. The set of any preceding embodiment, in which each of the plurality of structural elements comprises one or more characters adjacent each slot, wherein the character identifying a slot of a first structural element matches the character identifying a corresponding slot of a second structural element to which the first structural element is designed to be connected.

B28. The set of any preceding embodiment, in which, for each of the first subset of structural elements or each of the second subset of structural elements, each slot is identified with a character that is different from that used to identify each other slot present on the structural element.

B29. The set of any preceding embodiment, in which each of the first subset of structural elements comprises one or more characters that identify its placement relative to the other structural elements within the first subset, in which each of the second subset of structural elements comprises one or more characters that identify its placement relative to the other structural elements within the second subset, or both.

B30. The set of any preceding embodiment, in which the characters comprise letters, numbers, or a combination thereof.

B31. The set of any preceding embodiment, in which the characters are etched into the first side surface of the structural element, the second side surface of the structural element, or both.

B32. The set of any preceding embodiment, in which one or more of the structural elements, and optionally each of a plurality of structural elements, comprises an aperture spanning between the first and second side surfaces and configured to receive a tube or portion of a tube.

B33. The set of any preceding embodiment, in which the plurality of structural elements comprises at least six structural elements, alternatively at least eight structural elements, alternatively at least ten structural elements, alternatively at least twelve structural elements.

B34. The set of any preceding embodiment, in which the first subset of structural elements comprises at least three structural elements, alternatively at least four structural elements, alternatively at least five structural elements, alternatively at least six structural elements; and the second subset of structural elements comprises at least three structural elements, alternatively at least four structural elements, alternatively at least five structural elements, alternatively at least six structural elements.

B35. The set of any preceding embodiment, wherein at least one, and optionally each, of the structural elements has a front edge and a rear edge, each of which extend vertically a desired length.

B36. The set of any preceding embodiment, wherein the set is configured to produce an artificial mound having a customized surface contour.

B37. A flat pack assembly comprising the set of any preceding embodiment.

Methods

C1. A method of making an artificial mound using a set of structural elements, each of which comprises first and second side surfaces, an upper edge, and a lower edge; in which the upper edges of the plurality of structural elements are shaped to provide the artificial mound with a surface having a predetermined contour; the method comprising:

assembling a structural framework by connecting the structural elements together in a predefined manner;

filling the spaces formed by the structural framework with a fill material;

applying one or more layers over top of the structural framework and fill material.

C2. The method of any preceding embodiment, further comprising providing the set of structural elements.

C3. A method comprising:

providing a set of structural elements, each of which comprises first and second side surfaces, an upper edge, and a lower edge; in which the upper edges of the plurality of structural elements are shaped to provide an artificial mound with a surface having a predetermined contour; and instructing or otherwise causing one or more entities, e.g. an installer, to:

assemble a structural framework by connecting the structural elements together in a predefined manner, optionally wherein the predefined manner is identified by a set of instructions, by the structural elements, or both;

fill the spaces formed by the structural framework with a fill material; and apply one or more layers over top of the structural framework, fill material, or both.

C4. The method of any preceding embodiment, wherein providing the set of structural elements comprises designing a plurality of structural elements using computer software and cutting the plurality of structural elements, optionally from a sheet of material, optionally using a computer-controlled cutting tool.

C5. The method of any preceding embodiment, wherein providing the set of structural elements comprises transporting the set of structural elements to an installation site in a flat pack assembly.

C6. The method of any preceding embodiment, wherein providing the set of structural elements comprises providing instructions for assembling the framework structure, filling the spaces with the fill material, and/or applying the one or more layers.

C7. The method of any preceding embodiment, in which the fill material comprises or consists of crushed stone.

C8. The method of any preceding embodiment, wherein the one or more layers comprises a support layer and a cushion layer.

C9. The method of any preceding embodiment, wherein the support layer comprises or consists of concrete.

C10. The method of any preceding embodiment, wherein the cushion layer comprises or consists of poured-in-place rubber.

C11. The method of any preceding embodiment, further comprising a finish layer.

C12. The method of any preceding embodiment, wherein the finish layer comprises or consists of poured-in-place rubber (e.g. a cap layer), synthetic grass, or turf.

C13. The method of any preceding claim, in which one or more of the structural elements comprises a level indicator a defined distance from the upper edge, and wherein filling the spaces formed by the structural framework with a fill material comprises filling the spaces to the level indicator.

C14. The method of any preceding embodiment, wherein the level indicator comprises one or more apertures.

C15. The method of any preceding embodiment, wherein the one or more apertures are sized and configured to receive a user's fingers, such that the one or more apertures serve as a handle.

C16. The method of any preceding embodiment, wherein the lower edge of the one or more apertures serves as the level indicator.

C17. The method of any preceding embodiment, wherein the step of applying one or more layers over top of the structural framework and fill material comprises applying a support layer, optionally concrete, between the level indicator and the upper edges of the structural elements.

C18. The method of any preceding embodiment, further comprising mounting a playground component such that a portion of the playground component extends into one or more of the spaces formed by the structural framework, optionally wherein the mounting step is performed prior to filling the spaces formed by the structural framework with a fill material.

C19. The method of any preceding embodiment, further comprising filling the space surrounding the playground component with concrete.

C20. The method of any preceding embodiment, wherein at least one of the one or more layers are applied over top of the structural framework, fill material, or both such that the playground component projects from an uppermost layer of the one or more layers.

C21. The method of any preceding embodiment, further comprising forming a tunnel through the mound by inserting one or more tube elements through apertures in one or more of the structural elements, optionally wherein the step of inserting is performed prior to filling the spaces formed by the structural framework with a fill material.

C22. The method of any preceding embodiment, wherein the structural framework comprises a first subset of structural elements arranged with their longitudinal axes extending in a first direction and a second subset of structural elements arranged with their longitudinal axes extending in a second direction, the second direction being transverse to the first direction.

C23. The method of any preceding embodiment, wherein the second direction is perpendicular to the first direction.

C24. The method of any preceding embodiment, wherein at least one of the structural elements comprises one or more slots, each of the one or more slots being positioned at one of the predetermined points of connection with another structural element and configured to receive a portion of the structural element to which it is connected.

C25. The method of any preceding embodiment, wherein each of the structural elements comprises one or more slots, each of the one or more slots being positioned at one of the predetermined points of connection with another structural element and configured to receive a portion of the structural element to which it is connected.

C26. The method of any preceding embodiment, wherein each of the first subset of structural elements comprises one or more slots, each slot being positioned at one of the predetermined points of connection with one of the second subset of structural elements and configured to receive a portion of the structural element to which it is connected.

C27. The method of any preceding embodiment, wherein each of the second subset of structural elements comprises one or more slots, each slot being positioned at one of the predetermined points of connection with one of the first subset of structural elements and configured to receive a portion of the structural element to which it is connected.

C28. The method of any preceding embodiment, wherein the slots of the first subset of structural elements extend upward from the lower edges of the structural elements and the slots of the second subset of structural elements extend downward from the upper edges of the structural elements.

C29. The method of any preceding embodiment, wherein the slots of the second subset of structural elements receive portions of the first subset of structural elements immediately above the slots of the first subset of structural elements; and the slots of the first subset of structural elements receive portions of the second subset of structural elements immediately below the slots of the second subset of structural elements.

C30. The method of any preceding embodiment, wherein at least one, and optionally each, of the structural elements is made of plastic, optionally wherein the plastic is high density polyethylene.

C31. The method of any preceding embodiment, wherein the first and second side surfaces are flat or substantially flat.

C32. The method of any preceding embodiment, further comprising transporting the structural elements or causing the structural elements to be transported to an installation site as a flat pack assembly.

C33. The method of any preceding embodiment, wherein each structural element has a thickness (between the first and second side surfaces) less than 4 inches, alternatively less than 3 inches, alternatively less than 2 inches.

C34. The method of any preceding embodiment, wherein a ground surface on which the structural framework is assembled is substantially flat, and wherein the lower edge of each structural element is straight and extends along the longitudinal axis.

C35. The method of any preceding embodiment, wherein a ground surface on which the structural framework is assembled is irregular, and wherein the lower edge of one or more of the structural elements corresponds to an irregularity of the ground surface.

C36. The method of any preceding embodiment, in which each of the plurality of structural elements comprises one or more characters adjacent each slot, and wherein the step of assembling a structural framework by connecting the structural elements together in a grid comprises matching the character adjacent a slot of a first structural element with the character adjacent a slot of a second structural element, aligning the slot of the first structural element with the slot of the second structural element, and connecting the first structural element with the second structural element.

C37. The method of any preceding embodiment, in which each of the first subset of structural elements comprises one or more characters that identify its placement relative to the other structural elements within the first subset, in which each of the second subset of structural elements comprises one or more characters that identify its placement relative to the other structural elements within the second subset, or both, and wherein the step of assembling a structural framework comprises using the one or more characters to arrange the first subset of structural elements and/or the second subset of structural elements.

C38. The method of any preceding embodiment, in which the characters comprise letters, numbers, or a combination thereof.

C39. The method of any preceding embodiment, in which the characters are etched into the first side surface of the structural element, the second side surface of the structural element, or both.

C40. The method of any preceding embodiment, wherein at least one of the structural elements comprises a curved upper edge.

C41. The method of any preceding embodiment, wherein at least one of the structural elements comprises an upper edge having a straight central portion extending along the longitudinal axis and first and second end portions that are angled or curved from the central portion toward the lower edge.

C42. The method of any preceding embodiment, wherein at least one of the structural elements comprises an upper edge having a first straight portion at a first height and a second straight portion at a second height, the second height differing from the first height.

C43. The method of any preceding embodiment, wherein at least one of the structural elements comprises an upper edge having a first portion and a second portion separated by a third, concave portion; optionally in which the first and second portions are straight and extend along the longitudinal axis.

C44. The method of any preceding embodiment, wherein at least one of the structural elements comprises an upper edge having a first portion and a second portion separated by a third, convex portion; optionally in which the first and second portions are straight and extend along the longitudinal axis.

C45. The method of any preceding embodiment, in which one or more of the plurality of structural elements is labeled to identify a predetermined position within the grid, optionally in which each of the plurality of structural elements is labeled to identify a predetermined position within the grid.

C46. The method of any preceding embodiment, in which the plurality of structural elements comprises at least six structural elements, alternatively at least eight structural elements, alternatively at least ten structural elements, alternatively at least twelve structural elements.

C47. The method of any preceding embodiment, in which the first subset of structural elements comprises at least three structural elements, alternatively at least four structural elements, alternatively at least five structural elements, alternatively at least six structural elements; and the second subset of structural elements comprises at least three structural elements, alternatively at least four structural elements, alternatively at least five structural elements, alternatively at least six structural elements.

C48. The method of any preceding embodiment, wherein at least one, and optionally each, of the structural elements has a front edge and a rear edge, each of which extend vertically a defined height.

What is claimed:

1. An artificial mound for a playground, comprising:

a structural framework comprising a first plurality of structural elements having longitudinal axes extending in a first direction, and a second plurality of structural elements having longitudinal axes extending in a second direction, wherein the second direction is transverse to the first direction, and each of the second plurality of structural elements is connected to one or more of the first plurality of structural elements; and wherein each structural element comprises an upper edge, the upper edges together providing the structural framework with a non-flat top surface that is configured to provide the artificial mound with a contoured surface;

a fill material in a plurality of spaces formed by the structural framework;

a support layer above the fill material; and a cushion layer above the support layer, wherein the cushion layer comprises poured-in-place rubber.

2. The artificial mound of claim 1, wherein the second direction is perpendicular or substantially perpendicular to the first direction, such that the longitudinal axes of the second plurality of structural elements form right angles with the longitudinal axes of the first plurality of structural elements.

3. The artificial mound of claim 1, wherein each of the second plurality of structural elements comprises one or more slots, each of the one or more slots receiving a portion of one of the first plurality of structural elements.

4. The artificial mound of claim 3, wherein each of the first plurality of structural elements comprises one or more slots, each of the one or more slots receiving a portion of one of the second plurality of structural elements.

5. The artificial mound of claim 4, wherein each of the one or more slots of the first plurality of structural elements extend upward from a lower edge of the first structural element and each of the one or more slots of the second plurality of structural elements extend downward from the upper edge of the second structural element.

6. The artificial mound of claim 5, wherein each of the one or more slots of the second plurality of structural elements receives a portion of one of the first plurality of structural elements positioned directly above one of the one or more slots of the first structural element; and each of the one or more slots of the first plurality of structural elements receives a portion of one of the second plurality of structural elements positioned directly below one of the one or more slots of the second structural element.

7. The artificial mound of claim 1, wherein each of the structural elements has flat or substantially flat side surfaces.

8. The artificial mound of claim 7, wherein each structural element has a thickness less than 3 inches.

9. The artificial mound of claim 1, wherein at least one of the structural elements is made of plastic.

10. The artificial mound of claim 1, wherein each of the structural elements comprises one or more level indicators a defined distance from an upper edge of the structural element.

11. The artificial mound of claim 10, wherein the one or more level indicators comprise one or more apertures.

12. The artificial mound of claim 10, wherein the fill material is present to the height identified by the one or more level indicators.

13. The artificial mound of claim 12, wherein the support layer is present between a top of the fill material and the upper edge of the structural framework.

14. The artificial mound of claim 1, wherein the fill material comprises crushed stone.

15. The artificial mound of claim 1, wherein the support layer comprises concrete.

16. The artificial mound of claim 1, further comprising a finish layer above the cushion layer.

17. The artificial mound of claim 16, wherein the finish layer comprises a poured-in-place rubber cap layer, synthetic grass, or turf.

18. The artificial mound of claim 1, further comprising a playground component integrated into the artificial mound.

19. The artificial mound of claim 18, in which a portion of the playground component extends between adjacent structural elements.

20. The artificial mound of claim 19, further comprising at least a surface layer that covers the structural framework, and wherein the surface layer contacts the playground component, such that the a portion of the playground component projects from the surface layer.

21. The artificial mound of claim 1, further comprising a tunnel extending through the mound.

22. The artificial mound of claim 1, further comprising a mobility device access element incorporated into the mound.

23. A playground comprising the artificial mound of claim 1.

* * * * *